US008010019B2

(12) United States Patent
Funamoto et al.

(10) Patent No.: US 8,010,019 B2
(45) Date of Patent: Aug. 30, 2011

(54) IMAGE FORMING APPARATUS

(75) Inventors: Noriaki Funamoto, Machida (JP); Joh Ebara, Kamakura (JP); Kazuhiko Kobayashi, Tokyo (JP); Keisuke Sugiyama, Yokohama (JP); Toshiyuki Uchida, Kawasaki (JP); Yasuhisa Ehara, Kamakura (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 11/972,136

(22) Filed: Jan. 10, 2008

(65) Prior Publication Data

US 2008/0213000 A1 Sep. 4, 2008

(30) Foreign Application Priority Data

Jan. 12, 2007 (JP) ..... 2007-004090

(51) Int. Cl.
*G03G 15/00* (2006.01)

(52) U.S. Cl. ..... 399/167; 399/67; 347/116

(58) Field of Classification Search ..... 399/167, 399/301; 347/116

See application file for complete search history.

(56) References Cited

U.S. PATENT DOCUMENTS

| | | | | |
|---|---|---|---|---|
| 5,881,346 | A | 3/1999 | Mori et al. | |
| 5,995,802 | A * | 11/1999 | Mori et al. | 399/394 |
| 6,920,303 | B2 | 7/2005 | Yamanaka et al. | |
| 6,952,557 | B2 | 10/2005 | Kobayashi | |
| 6,999,713 | B2 | 2/2006 | Kobayashi | |
| 7,050,737 | B2 | 5/2006 | Kobayashi | |
| 7,130,551 | B2 | 10/2006 | Kobayashi | |
| 7,136,600 | B2 | 11/2006 | Yamanaka et al. | |
| 7,206,537 | B2 | 4/2007 | Funamoto et al. | |
| 7,251,444 | B2 | 7/2007 | Matsuda et al. | |
| 2002/0085858 | A1 * | 7/2002 | Yamaguchi et al. | 399/167 |
| 2003/0081965 | A1 | 5/2003 | Ueda et al. | |
| 2003/0128995 | A1 * | 7/2003 | Ishii et al. | 399/49 |
| 2004/0151518 | A1 * | 8/2004 | Mizoguchi | 399/167 |
| 2005/0057209 | A1 | 3/2005 | Andoh et al. | |
| 2006/0024104 | A1 * | 2/2006 | Castelli et al. | 399/372 |
| 2006/0039722 | A1 | 2/2006 | Ehara | |
| 2006/0056868 | A1 * | 3/2006 | Ebara et al. | 399/49 |
| 2006/0088345 | A1 | 4/2006 | Koizumi | |
| 2006/0133873 | A1 | 6/2006 | Andoh et al. | |
| 2006/0182465 | A1 | 8/2006 | Funamoto et al. | |
| 2006/0182471 | A1 | 8/2006 | Okamura et al. | |
| 2006/0210325 | A1 | 9/2006 | Funamoto | |

(Continued)

FOREIGN PATENT DOCUMENTS

| | | |
|---|---|---|
| JP | 9-146329 | 6/1997 |

(Continued)

*Primary Examiner* — David Gray
*Assistant Examiner* — Roy Yi
(74) *Attorney, Agent, or Firm* — Oblon, Spivak, McClelland, Maier & Neustadt, L.L.P.

(57) ABSTRACT

An image forming apparatus that includes a plurality of image bearing members, a plurality of drive sources each including a drive gear, a plurality of driven gears, a visible image forming unit, an endless traveling member, a transfer unit, an image detection unit, and a controller. The controller controls rotation of the plurality of image bearing members according to a velocity fluctuation pattern of each surface of the image bearing members based on a detection time interval between predetermined visible detection images formed on the surface of the image bearing member and transferred therefrom to the endless traveling member detected by the image detection unit. Each of the plurality of driven gears includes a gear portion and an engaging portion integrated therewith. The gear portion includes a geared circumference and the engaging portion engages the image bearing member.

11 Claims, 18 Drawing Sheets

U.S. PATENT DOCUMENTS

| | | | | |
|---|---|---|---|---|
| 2007/0036589 | A1 | 2/2007 | Yamanaka et al. | |
| 2007/0110477 | A1 | 5/2007 | Handa et al. | |
| 2007/0140736 | A1 | 6/2007 | Ehara et al. | |
| 2007/0166075 | A1 | 7/2007 | Funamoto et al. | |
| 2007/0189815 | A1 | 8/2007 | Andoh et al. | |
| 2007/0196132 | A1 | 8/2007 | Kobayashi et al. | |
| 2007/0253736 | A1 | 11/2007 | Ehara et al. | |
| 2007/0258729 | A1 | 11/2007 | Ehara et al. | |
| 2007/0274746 | A1 | 11/2007 | Ehara et al. | |
| 2008/0231223 | A1 * | 9/2008 | Imai et al. | 318/683 |

FOREIGN PATENT DOCUMENTS

| | | |
|---|---|---|
| JP | 3186610 | 5/2001 |
| JP | 2006-47920 | 2/2006 |

* cited by examiner

IMAGE FORMING APPARATUS

CROSS-REFERENCE TO RELATED APPLICATION

This patent specification is based on and claims priority from Japanese Patent Application No. 2007-004090 filed on Jan. 12, 2007 in the Japan Patent Office, the entire contents of which are hereby incorporated by reference herein.

BACKGROUND

1. Field of the Invention

The present invention relates to an image forming apparatus.

2. Description of the Related Art

In an image forming apparatus such as a copier, a facsimile machine, or a printer, visible images are formed, for example, on each of a plurality of rotating image bearing members such as photosensitive elements and transferred at transfer positions to an endless traveling member such as an intermediate transfer belt or a recording medium held on the endless traveling member, such that the visible images are superimposed one atop another. In this type of the image forming apparatus, each of the visible images may be displaced from each other in a sub-scanning direction, i.e., the direction of rotation of the image bearing member, during transfer due to, for example, an eccentricity of a driven gear that rotates coaxially with the image bearing member and transmits a rotary drive force to the image bearing member. Specifically, a driven gear that has an eccentricity causes fluctuation in the velocity of the image bearing member. The velocity varies in sine wave form with a cycle of a rotation lap of the image bearing member. This is because, when a driven gear having an eccentricity is meshed with a drive gear of a drive motor, the linear velocity of the surface of an image bearing member engaging the driven gear is slowest at the point where the radius of the driven gear is greatest, and fastest at the point where the radius of the driven gear is shortest, and both points are 180 degrees apart from each other with respect to the rotation shaft of the driven gear and the image bearing member.

A dot formed on an image bearing member that rotates at a faster velocity arrives at the transfer position earlier than usual. By contrast, a dot formed on an image bearing member that rotates at a slower velocity arrives at the transfer position later than usual. Accordingly, for example, a transferred sooner-than-usual dot is overlapped onto a transferred later-than-usual dot from a different image bearing member, or a transferred later-than-usual dot is overlapped onto a transferred sooner-than-usual dot. This causes dot displacement, resulting in image displacement in the sub-scanning direction.

There is known an image forming apparatus that can rotate an image bearing member based on a drive velocity pattern that cancels the velocity fluctuation pattern thereof that causes such image displacement. The mechanism involves: Forming detection toner images arranged on the surface of a drum-like image bearing member with a particular interval in the surface moving direction thereof; transferring the images to a transfer belt; detecting each detection toner image on the transfer belt by a photosensor; detecting the velocity fluctuation pattern per rotation lap of the image bearing member based on the detected intervals between the detection toner images; determining the drive velocity pattern that cancels the velocity fluctuation of the image bearing member; and driving the image bearing member based on the drive velocity pattern when an image is formed using image information sent from a personal computer, etc. When an image forming apparatus has multiple image bearing members, the drive velocity pattern is determined for each of the image bearing members.

There is known another image forming apparatus that can prevent image displacement caused by velocity fluctuation of photosensitive elements by relatively synchronizing phases of the velocity fluctuation patterns thereof. Similar to the above-described image forming apparatus, the velocity fluctuation pattern per rotation lap of the photosensitive element is detected based on detected intervals between detection toner images. At the same time, a reference mark provided to the driven gear that rotates coaxially with the photosensitive element is detected by another photosensor to detect when rotation of the photosensitive element arrives at a particular angle. The relation between such detected rotation timing and the phase of the velocity fluctuation pattern is determined for each photosensitive element, on the basis of which the phase difference between the velocity fluctuation patterns of the photosensitive elements is adjusted by temporarily changing the driving velocity of drive motors that drive the respective photosensitive elements. By this temporary change, images arriving at the transfer positions sooner than usual, or images arriving at the transfer positions later than usual, can be synchronized with each other. Thus, image displacement can be prevented.

When photosensitive elements are arranged in an image forming apparatus at an interval that is an integral multiple of the circumference of the photosensitive element, each photosensitive element rotates integral times while a toner image on, for example, a recording medium is moved from one transfer position to the transfer position of the next toner image. Therefore, by adjusting the phase difference between the velocity fluctuation patterns of the photosensitive elements to zero, the images are appropriately overlapped at each transfer position. When the photosensitive elements are not arranged at an interval that is an integral multiple of the circumference of the photosensitive element, dots are appropriately overlapped at each transfer position by providing a phase difference with a particular period of time to the velocity fluctuation pattern of each photosensitive element.

However, there are some cases in which driving each photosensitive element according to the drive velocity pattern or adjusting the phase of the velocity fluctuation pattern of each photosensitive element is not sufficient to prevent image displacement. The reason for this is as follows.

A typical photosensitive element is structured to be easily attached to and detached from an image forming apparatus to improve maintenance efficiency. By comparison, a driven gear that rotates coaxially with the photosensitive element and transmits a rotary drive force to the photosensitive element is rotatably fixed to the image forming apparatus. When the photosensitive element is installed in the image forming apparatus, one end of the rotation shaft of the photosensitive element engages the driven gear. The driven gear in the image forming apparatus having the above-described configuration includes a tubular engagement portion and a disk-like gear portion. The engagement portion is fitted into and protrudes from the center of the gear portion along the axial direction.

FIG. 1 is a perspective view illustrating a photosensitive element 3 and a photosensitive element gear 133 included in a typical image forming apparatus. The photosensitive element 3 is included in a process unit, not shown, that is detachably installed in the image forming apparatus. The rotation shaft of the photosensitive element 3 protrudes from both sides in the axial direction of the drum portion of the photosensitive element 3. At one end of the rotation shaft, a coupling 3*b* is formed to engage an engaging portion 133*b* included in the photosensitive element gear 133.

The photosensitive element gear 133 is rotatably fixed to the image forming apparatus and includes a disk-like gear portion 133*a* having a geared circumference, not shown, and the engaging portion 133*b* that engages the coupling 3*b* of the photosensitive element 3. The engaging portion 133*b* has a size in the rotating axial direction to engage the coupling 3*b*, which slides in the rotating axial direction when the process unit is assembled. Therefore, the photosensitive element gear 133 is configured such that the engaging portion 133*b* significantly protrudes in the axial direction from the center of the disk-like gear portion 133*a*.

FIG. 2 illustrates the photosensitive element gear 133 included in a typical image forming apparatus. In FIG. 2, an insertion hole 133*c* that receives the base side of the engaging portion 133*b* is formed at the center of the disk-like gear portion 133*a*. Around the insertion hole 133*c*, a pin groove 133*d* is formed to receive a pin.

The engaging portion 133*b* is fixed to the gear portion 133*a* when the base side of the engaging portion 133*b* is inserted into the insertion hole 133*c* of the gear portion 133*a*. Also, a pin protruding from the circumference surface on the base side of the engaging portion 133*b* is inserted into the pin groove 133*d* of the gear portion 133*a* to prevent idling of the engaging portion 133*b* in the insertion hole 133*c*.

In the image forming apparatus having the above-described configuration, a slight rattling movement may be produced between the gear portion 133*a* and the engaging portion 133*b* inserted thereto due to an error in the dimensional accuracy of the gear portion 133*a* or the engaging portion 133*b*. Due to this rattling, the velocity fluctuation pattern of the photosensitive element gear 133 per rotation slightly varies from rotation to rotation. As a result, the drive velocity pattern detected based on the predetermined detection toner images as described above does not match the actual velocity fluctuation pattern during image formation, which makes prevention of image displacement difficult.

SUMMARY

This patent specification describes a novel image forming apparatus that includes a plurality of image bearing members to bear visible images on rotating surfaces thereof, a plurality of drive sources to individually drive the image bearing members, each of the plurality of drive sources including a drive gear, a plurality of driven gears to individually engage the image bearing members on rotation axes of the image bearing members and mesh with the drive gears, a visible image forming unit to form the visible images on each of the image bearing members based on image information, an endless traveling member to endlessly move a surface thereof to sequentially pass positions facing the image bearing members, a transfer unit to transfer the visible images formed on each of the surfaces of the image bearing members to a recording medium held on the surface of the endless traveling member or to the surface of the endless traveling member and to the recording medium, an image detection unit to detect the visible images formed on the surface of the endless traveling member, and a controller to control rotation of the plurality of image bearing members according to a velocity fluctuation pattern of each surface of the image bearing members based on a detection time interval between predetermined visible detection images formed on the surface of the image bearing member and transferred therefrom to the endless traveling member detected by the image detection unit. Each of the plurality of driven gears includes a gear portion and an engaging portion integrated therewith. The gear portion includes a geared circumference and the engaging portion engages the image bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
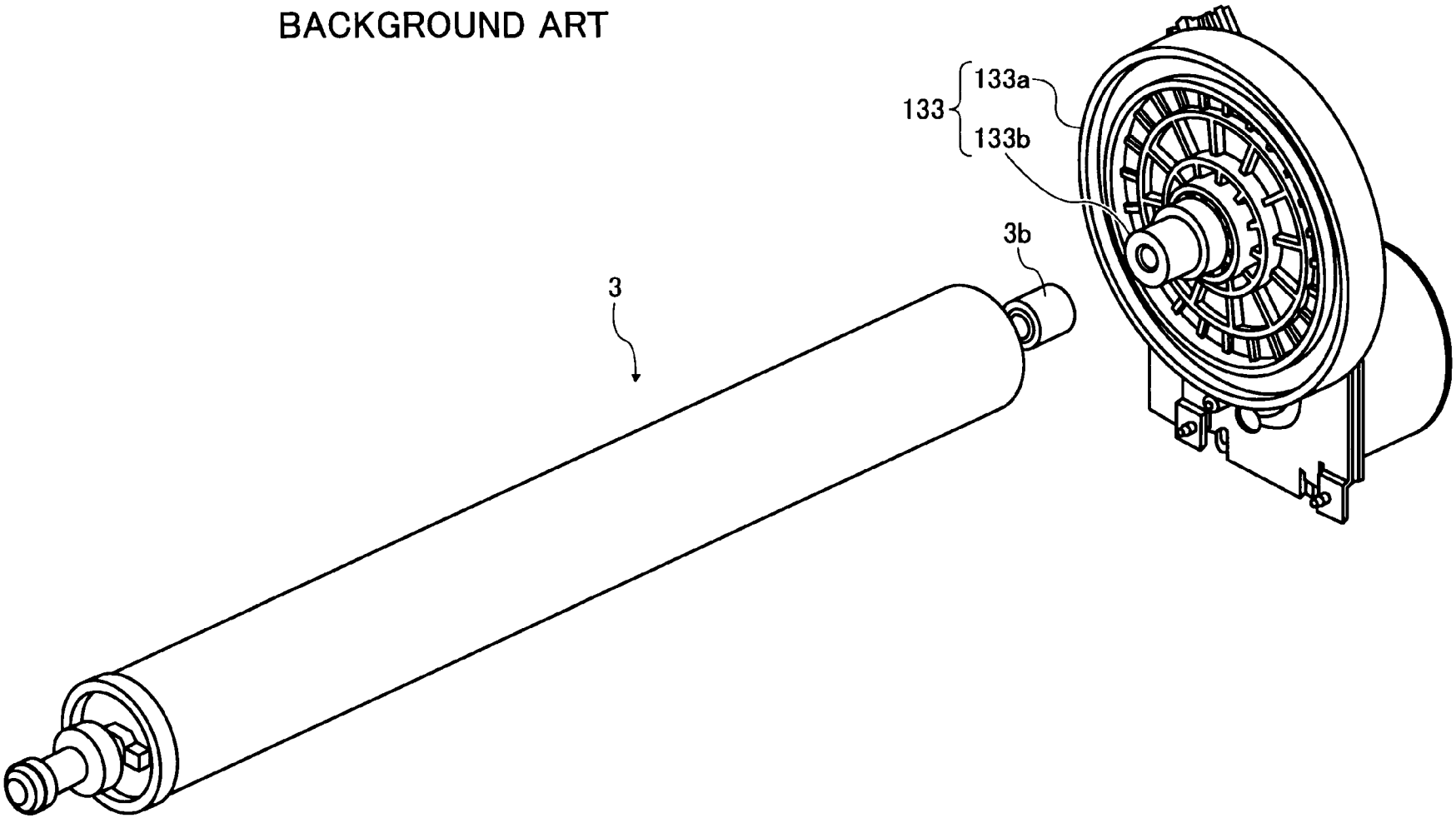
FIG. 1 BACKGROUND ART
FIG. 1 is a perspective view illustrating a photosensitive element and a photosensitive element gear included in a typical image forming apparatus.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 23:
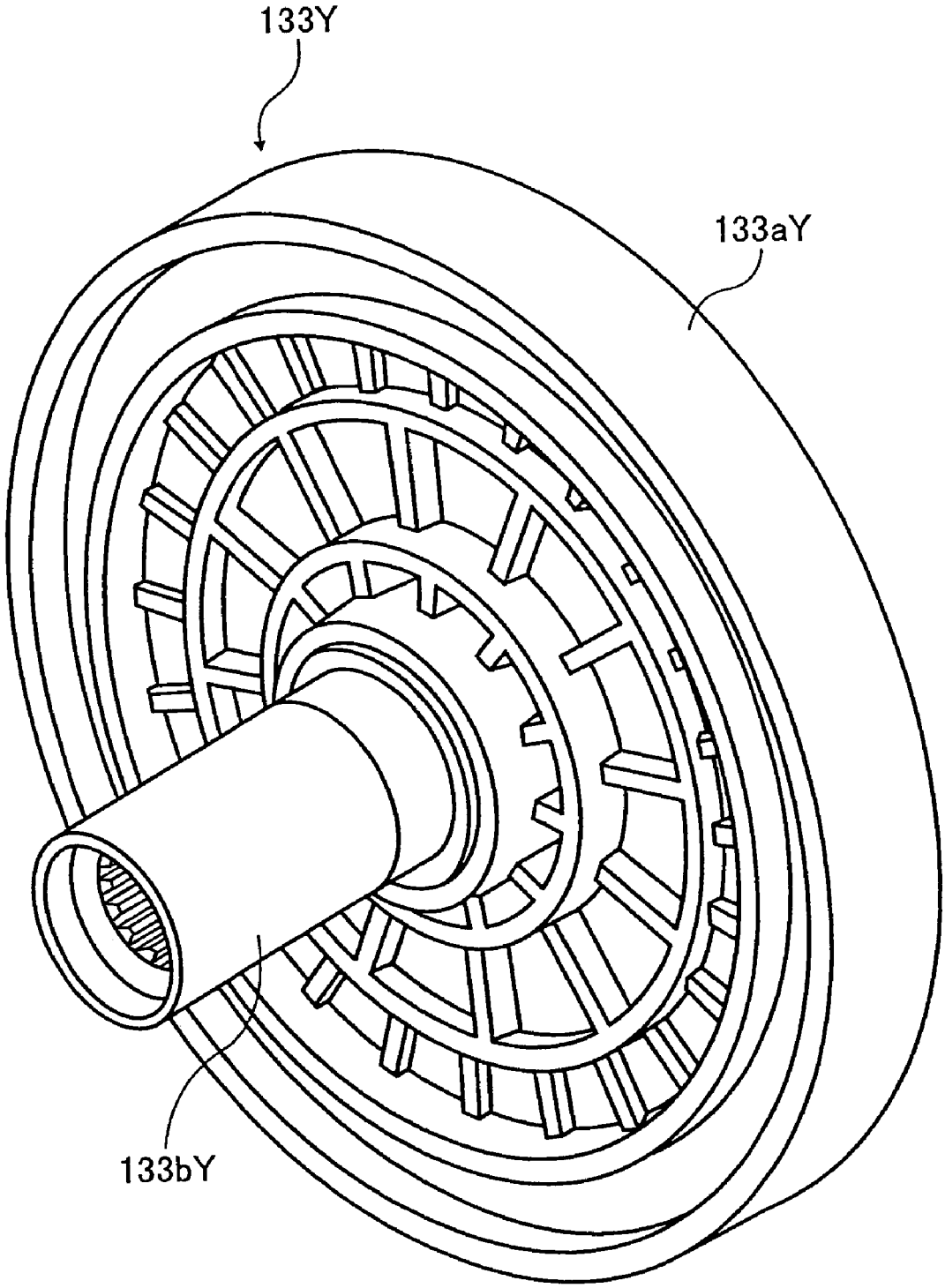
FIG. 23 is a perspective view illustrating the photosensitive element gear included in the printer.

Referring now to the drawings, wherein like reference numerals designate identical or corresponding parts throughout the several views thereof, particularly to FIG. 23, image forming apparatuses according to exemplary embodiments of the present invention are described.

Figure 3:
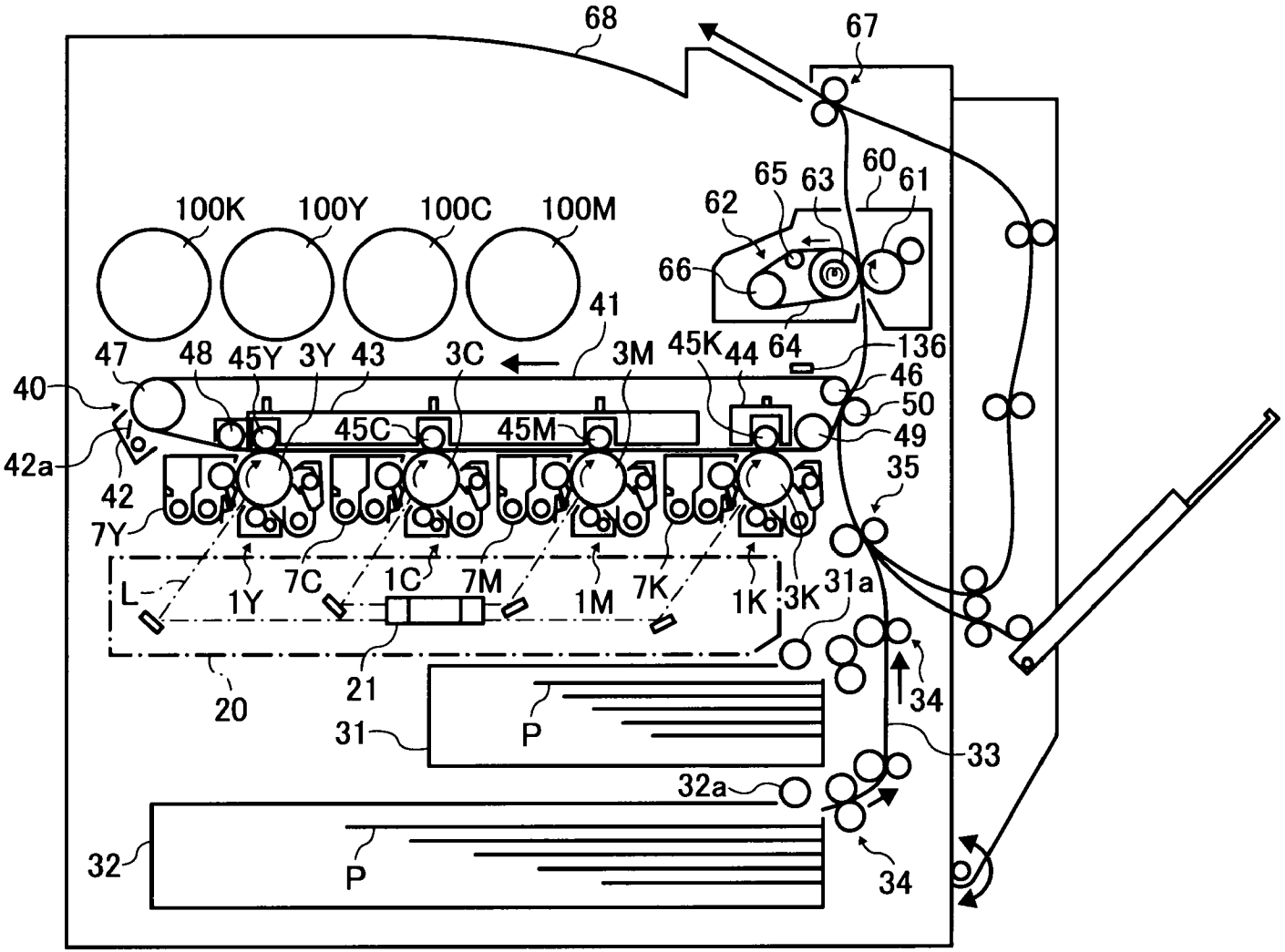
FIG. 3 is a diagram illustrating a schematic configuration of a printer according to a first embodiment of the present invention.
Figure 4:
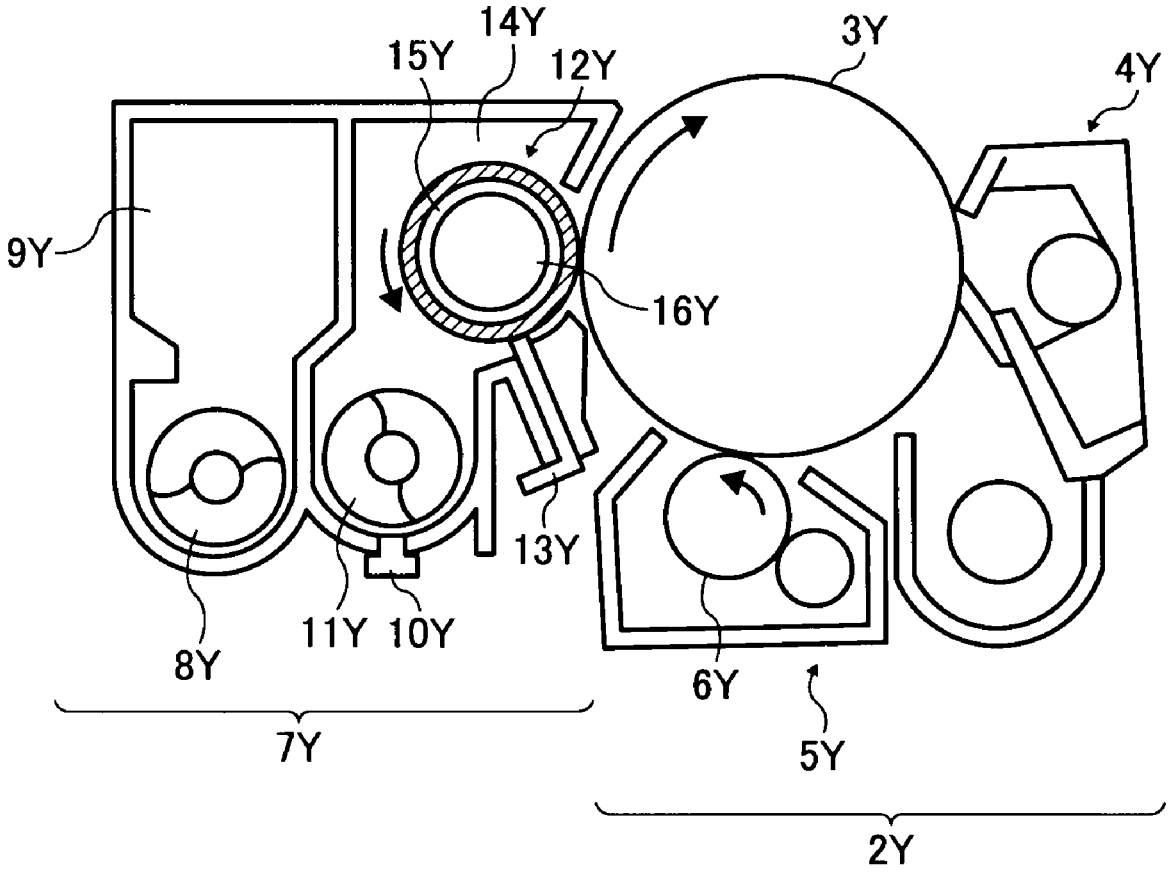
FIG. 4 is an enlarged view illustrating a process unit of the printer shown in FIG. 3.
Figure 5:
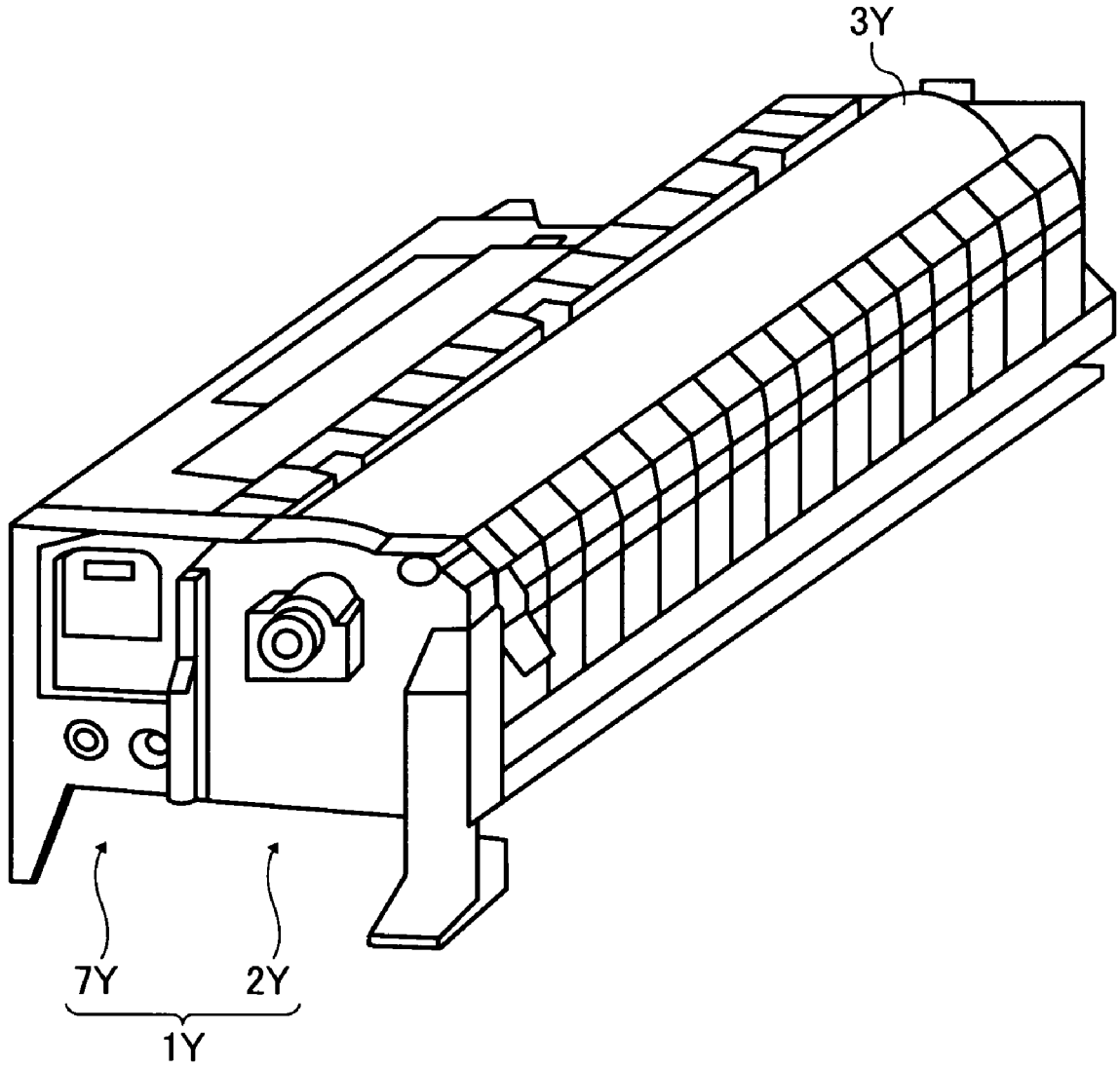
FIG. 5 is a perspective view illustrating the process unit shown in FIG. 4.
Figure 6:
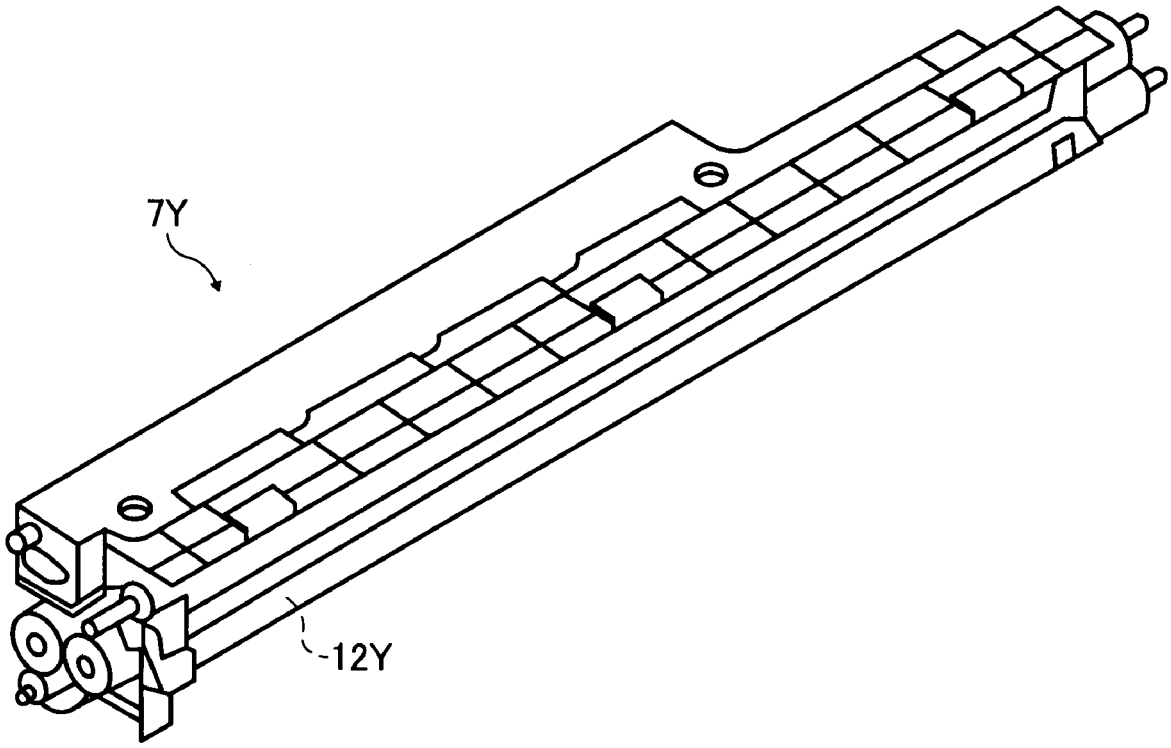
FIG. 6 is a perspective view illustrating a development unit included in the process unit.

FIG. 3 is a diagram illustrating a schematic configuration of an electrophotographic printer (hereinafter referred to as printer) according to an embodiment of the present invention. The printer includes four process units 1Y, 1C, 1M, and 1K that form toner images of yellow, cyan, magenta, and black, which are abbreviated as Y, C, M, and K, respectively. The abbreviations may be omitted as necessary. The process units 1Y, 1C, 1M, and 1K have the same configuration using toners of different colors: Y toner, C toner, M toner, and K toner, respectively. By way of example, the process unit 1Y is described. The process unit 1Y that forms a Y toner image includes a photosensitive element unit 2Y and a development unit 7Y as illustrated in FIG. 4. The photosensitive element unit 2Y and the development unit 7Y are integrated as the process unit 1Y and attached to and detached from the printer as illustrated in FIG. 5. The development unit 7Y can be attached to and detached from the photosensitive element unit 2Y when the process unit 1Y is detached from the printer as illustrated in FIG. 6.

Referring to FIG. 4, the photosensitive element unit 2Y includes a drum-like photosensitive element 3Y, a drum cleaning device 4Y, a discharging device, not shown, and a charging device 5Y.

The photosensitive element 3Y is rotated clockwise in FIG. 4 by a drive unit, not shown, and uniformly charged by the charging device 5Y. In the charging device 5Y, a charging roller 6Y is provided in the vicinity of the photosensitive element 3Y. The charging roller 6Y is rotationally driven counterclockwise in FIG. 4 and a charging bias is applied to the charging roller 6Y from a power supply, not shown, to uniformly charge the surface of the photosensitive element 3Y. Instead of the charging roller 6Y, a charging brush may be used in such a manner that the charging brush is in contact with the photosensitive element 3Y. Alternatively, the photosensitive element 3Y may be uniformly charged using a charger such as a scorotron. The uniformly charged surface of the photosensitive element 3Y is then scanned and irradiated with a laser beam L emitted from an optical writing unit 20 to form and bear a latent electrostatic image for Y thereon.

The development unit 7Y includes a first container 9Y and a second container 14Y. The first container 9Y includes a first conveying screw 8Y and the second container 14Y includes a toner density sensor 10Y formed of a magnetic permeability sensor, a second conveying screw 11Y, a development roller 12Y, and a doctor blade 13Y. The first container 9Y and the second container 14Y hold a Y developer, not shown, that contains a magnetic carrier and negatively chargeable Y toner. The first conveying screw 8Y is rotated by a drive unit, not shown, to convey the Y developer in the first container 9Y from front to rear in FIG. 4. The Y developer is introduced into the second container 14Y through an opening, not shown, in a partition wall that separates the first container 9Y from the second container 14Y.

The second conveying screw 11Y in the second container 14Y is rotated by a drive unit, not shown, to convey the Y developer from rear to front in FIG. 4. While conveying the Y developer, the toner density sensor 10Y fixed to the bottom of the second container 14Y detects the toner density in the Y developer. Above the second conveying screw 11Y, the development roller 12Y is provided in parallel to the second conveying screw 11Y. The development roller 12Y includes a development sleeve 15Y serving as a developer member. The development sleeve 15Y is formed of a nonmagnetic tube and rotated counterclockwise in FIG. 4. The development sleeve 15Y includes a magnet roller 16Y that exerts magnetic force to draw some of the Y developer conveyed by the second conveying screw 11Y to the surface of the development sleeve 15Y. The doctor blade 13Y maintains a particular gap from the development sleeve 15Y and regulates the thickness of the Y developer layer. When the Y developer is conveyed to a development region facing the photosensitive element 3Y, the Y toner is attracted to the latent electrostatic image for Y on the photosensitive element 3Y to form a Y toner image thereon. After the Y toner is thus consumed by the development, the Y developer is returned to the second conveying screw 11Y as the development sleeve 15Y rotates. At the front end side of the second conveying screw 11Y of FIG. 4, the Y developer is returned to the first container 9Y through an opening, not shown.

The detection result of the magnetic permeability of the Y developer detected by the toner density sensor 10Y is transmitted as a voltage signal to a control unit, not shown. This control unit includes a CPU (Central Processing Unit) serving as a computing unit, a RAM (Random Access Memory) serving as a data storage unit, and a ROM (Read Only Memory) and performs various arithmetic processing and executes control programs. Since the magnetic permeability of the Y developer correlates with the Y toner density of the Y developer, the voltage output from the toner density sensor 10Y corresponds to the Y toner density. The RAM included in the control unit stores data of a target value $V_{tref}$ for Y of the output voltage from the toner density sensor 10Y and target values $V_{tref}$ for C, $V_{tref}$ for M, and $V_{tref}$ for K of output voltages from the toner density sensors 10C, 10M, and 10K, respectively. As for the development unit 7Y, the value of the output voltage from the toner density sensor 10Y is compared with the $V_{tref}$ for Y and a toner supply device for Y, not shown, is driven for a period of time that is determined based on the comparison result. Accordingly, Y toner is replenished in the first container 9Y so that Y toner consumed during development is replenished. Therefore, the Y toner density of the Y developer in the second container 14Y is maintained in a particular range. As for the developers in the process units 1C, 1M, and 1K, toner replenishment is controlled in the same manner.

The Y toner image formed on the photosensitive element 3Y, which serves as an image bearing member and a latent electrostatic image bearing member, is transferred to an intermediate transfer belt 41 (intermediate transfer process). The drum cleaning device 4Y in the photosensitive element unit 2Y removes toner remaining on the surface of the photosensitive element 3Y after the intermediate transfer process. Thereafter, the discharging device, not shown, discharges the surface of the photosensitive element 3Y, such that the surface of the photosensitive element 3Y is initialized and readied for the next image formation. C, M, and K toner images are formed on the photosensitive elements 3C, 3M, and 3K in the process units 1C, 1M, and 1K, respectively, and transferred to the intermediate transfer belt 41 in the same way.

Below the process units 1Y, 1C, 1M, and 1K, the optical writing unit 20 is provided. The optical writing unit 20 serves as a latent image forming unit and irradiates the photosensitive elements 3Y, 3C, 3M, and 3K in the process units 1Y, 1C, 1M, and 1K with laser beams L based on image information to form latent electrostatic images for Y, C, M, and K on the photosensitive elements 3Y, 3C, 3M, and 3K, respectively. The optical writing unit 20 irradiates the photosensitive elements 3Y, 3C, 3M, and 3K by way of a plurality of optical lenses and mirrors including a polygon mirror 21 that is rotated by a motor and deflects the laser beams L emitted from an optical source. Alternatively, the irradiation may be performed by using an LED array.

Below the optical writing unit 20, a first paper feed cassette 31 and a second paper feed cassette 32 are disposed one above the other in the upright direction. The first paper feed cassette 31 and the second paper feed cassette 32 store a plurality of recording media P therein, with a first paper feed roller 31*a* and a second paper feed roller 32*a* being in contact with the uppermost recording media P in respective paper feed cassettes. When the first paper feed roller 31*a* is rotated counterclockwise by a drive unit, not shown, the uppermost recording medium P in the first paper feed cassette 31 is output to a paper feed path 33 extending vertically along the right side of the first paper feed cassette 31. When the second paper feed roller 32*a* is rotated counterclockwise by a drive unit, not shown, the uppermost recording medium P in the second paper feed cassette 32 is output to the paper feed path 33. In the paper feed path 33, a plurality of conveyance rollers 34 is provided. The recording medium P fed into the paper feed path 33 is conveyed upward while being pinched between the conveyance rollers 34.

At the end of the paper feed path 33, a pair of registration rollers 35 is provided. The registration rollers 35 pinch the recording medium P conveyed by the conveyance rollers 34 and immediately suspend their rotation. The registration rollers 35 convey the recording medium P to a secondary transfer nip, which is described below, at an appropriate timing.

Above the process units 1Y, 1C, 1M, and 1K, a transfer unit 40 is provided. In the transfer unit 40, the intermediate transfer belt 41, which is an endless traveling member, is stretched and endlessly moves counterclockwise. The transfer unit 40 also includes a belt cleaning unit 42, a first bracket 43, and a second bracket 44. The transfer unit 40 further includes four primary transfer rollers 45Y, 45C, 45M, and 45K, a secondary transfer back-up roller 46, a drive roller 47, an auxiliary roller 48, and a tension roller 49. The intermediate transfer belt 41 is stretched over these eight rollers and endlessly moved counterclockwise by the driven roller 47. Each of the four primary transfer rollers 45Y, 45C, 45M, and 45K and each of the corresponding photosensitive elements 3Y, 3C, 3M, and 3K form a primary transfer nip with the intermediate transfer belt 41 therebetween. A transfer bias with a reverse polarity to that of the toner, for example, a positive polarity, is applied to the back side (inner circumference side) of the intermediate transfer belt 41. The Y, C, M, and K toner images on the photosensitive elements 3Y, 3C, 3M, and 3K are primarily transferred to and superimposed one atop another on the front side of the intermediate transfer belt 41 while passing through the primary transfer nips for Y, C, M, and K according to the endless movement of the intermediate transfer belt 41, thereby forming a four-color superimposed toner image (hereinafter referred to as a four-color toner image) on the intermediate transfer belt 41.

The secondary transfer back-up roller 46 and a secondary transfer roller 50 provided outside the loop of the intermediate transfer belt 41 form the secondary transfer nip with the intermediate transfer belt 41 therebetween. The registration rollers 35 convey the recording medium P pinched therebetween to the secondary transfer nip in sync with the four-color toner image on the intermediate transfer belt 41. The four-color toner image on the intermediate transfer belt 41 is secondarily transferred onto the recording medium P all at once by the secondary transfer electric field and nip pressure generated between the secondary transfer roller 50 to which a secondary transfer bias is applied and the secondary transfer back-up roller 46. The four-color toner image forms a full color image, with the color of the recording medium P as background.

After the intermediate transfer belt 41 passes through the secondary transfer nip, toner that has not been transferred to the recording medium P remains attached to the intermediate transfer belt 41. This residual toner is removed by the belt cleaning unit 42. The belt cleaning unit 42 includes a cleaning blade 42*a*. The cleaning blade 42*a* is in contact with the front side of the intermediate transfer belt 41 and scrapes off the toner remaining thereon.

The first bracket 43 in the transfer unit 40 is configured to swing at a particular degree relative to the rotation axis of the auxiliary roller 48 by switching of a solenoid, not shown. When a monochrome image is formed, the first bracket 43 is rotated slightly counterclockwise by driving of the solenoid so that the primary transfer rollers 45Y, 45C, and 45M are rotated counterclockwise relative to the rotation axis of the auxiliary roller 48. Accordingly, the intermediate transfer belt 41 is separated from the photosensitive elements 3Y, 3C, and 3M and only the process unit 1K is driven to form a monochrome image. Consequently, the process units 1Y, 1C, and 1M are not driven during monochrome image formation, and thus it is possible to avoid excessive wear on the process units 1Y, 1C, and 1M.

Above the secondary transfer nip, a fixing unit 60 is provided. The fixing unit 60 includes a pressure and heat roller 61 including a heat source, such as a halogen lamp, and a fixing belt unit 62. The fixing belt unit 62 includes a fixing belt 64 serving as a fixing member, a heat roller 63 including a heat source such as a halogen lamp, a tension roller 65, a drive roller 66, and a temperature sensor, not shown. The endless fixing belt 64 is stretched around the heat roller 63, the tension roller 65, and the drive roller 66, and endlessly moved counterclockwise. During such endless movement, the back side of the fixing belt 64 is heated by the heat roller 63. The pressure and heat roller 61 rotating clockwise is in contact with the front side of the fixing belt 64 at a position where the fixing belt 64 is suspended around the heat roller 63, thereby forming a fixing nip therebetween.

The temperature sensor, not shown, is provided outside the loop of the fixing belt 64 to face the front side of the fixing belt 64 across a present gap. The temperature sensor detects the surface temperature of the fixing belt 64 immediately before the fixing belt 64 enters the fixing nip. The detection result is transmitted to a fixing power supply circuit, not shown. Based on the detection result, the fixing power supply circuit controls power supply to the heat sources included in the heat roller 63 and in the pressure and heat roller 61. Therefore, the surface temperature of the fixing belt 64 is maintained at approximately 140 degrees.

In FIG. 3, the recording medium P, once past the secondary transfer nip, is separated from the intermediate transfer belt 41 and forwarded to the fixing unit 60. In the fixing unit 60, while the recording medium P is pinched in the fixing nip and conveyed upward, the recording medium P is heated and pressed by the fixing belt 64 to fix the full color toner image thereon.

After the fixing, the recording medium P is discharged from the printer via a pair of discharge rollers 67. A stack portion 68 is formed on the upper surface of the printer and the recording medium P is stacked thereon.

Above the transfer unit 40, four toner cartridges 100Y, 100C, 100M, and 100K are provided to hold the Y, C, M, and K toners therein. The Y, C, M, and K toners in the toner cartridges 100Y, 100C, 100M, and 100K are supplied to the development units 7Y, 7C, 7M, and 7K in the process units 1Y, 1C, 1M, and 1K, respectively. The toner cartridges 100Y, 100C, 100M, and 100K are detachably installed in the printer, separately from the process units 1Y, 1C, 1M, and 1K.

Figure 7:
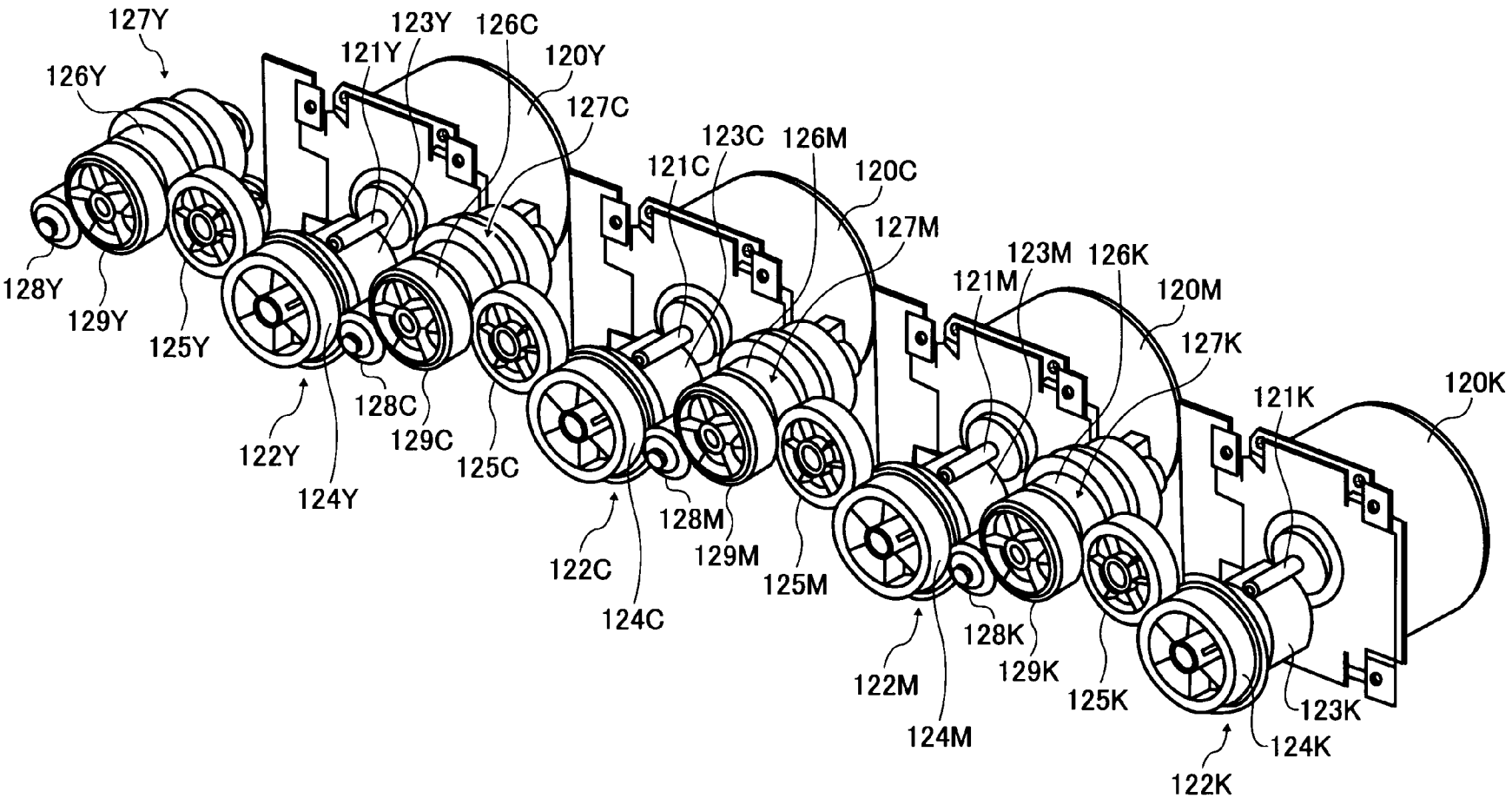
FIG. 7 is a perspective view illustrating a drive transmission unit fixed in the printer.
Figure 8:
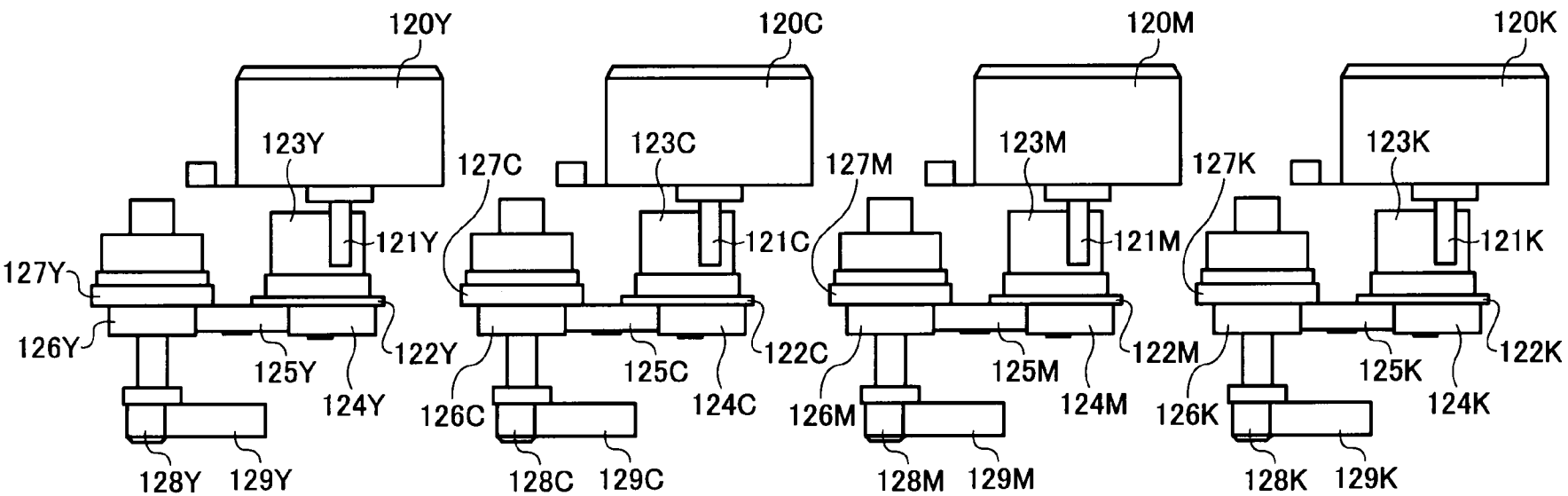
FIG. 8 is a plan view illustrating the drive transmission unit.

FIG. 7 is a perspective view illustrating a drive transmission unit fixed in the printer. FIG. 8 is a plan view illustrating the drive transmission unit as viewed from above. Four process drive motors 120Y, 120C, 120M, and 120K serving as drive sources are fixed to a support plate that is provided in a standing manner in the printer. To the rotation shafts of the process drive motors 120Y, 120C, 120M, and 120K, drive gears 121Y, 121C, 121M, and 121K are coupled, respectively, to rotate coaxially with the process drive motors 120Y, 120C, 120M, and 120K.

Below the rotation shafts of the process drive motors 120Y, 120C, 120M, and 120K, development gears 122Y, 122C, 122M, and 122K are provided, respectively. The development gears 122Y, 122C, 122M, and 122K may rotate in engagement with fixed shafts, not shown, provided to the support plate in a protruding manner. The development gears 122Y, 122C, 122M, and 122K include first gear portions 123Y, 123C, 123M, and 123K and second gear portions 124Y, 124C, 124M, and 124K, respectively. Each of the first gear portions 123Y, 123C, 123M, and 123K rotates coaxially with each of the second gear portions 124Y, 124C, 124M, and 124K, respectively. The second gear portions 124Y, 124C, 124M, and 124K are provided on one end of the rotation shafts of the process drive motors 120Y, 120C, 120M, and 120K, compared with the first gear portions 123Y, 123C, 123M, and 123K. The development gears 122Y, 122C, 122M, and 122K rotate about the fixed shafts by rotation of the process drive motors 120Y, 120C, 120M, and 120K by meshing the first gear portions 123Y, 123C, 123M, and 123K with the drive gears 121Y, 121C, 121M, and 121K, respectively.

Each of the process drive motors 120Y, 120C, 120M, and 120K is formed of, for example, a DC servo motor, which is one type of DC brushless motor, or a stepping motor. The speed reduction ratio between each of the drive gears 121Y, 121C, 121M, and 121K and each of photosensitive element gears 133Y, 133C, 133M, and 133K is, for example, 1:20. A single step reduction between the drive gear and the photosensitive element gear is to reduce a number of components, costs, and factors causing variation in transmission due to a mesh error or an eccentricity of the gears. To achieve the relatively large speed reduction ratio of 1:20 with the single step reduction, the photosensitive element gear is formed with a larger diameter than the photosensitive element. By using the photosensitive element gear with a large diameter, the pitch error on the surface of the photosensitive element that corresponds to each tooth meshed of the photosensitive element gear is reduced, and therefore the effect of uneven print density (banding) in the sub-scanning direction can be reduced. The speed reduction ratio is determined based on a speed range that achieves high efficiency and high accuracy rotation of the photosensitive element according to the relation between a target speed of the photosensitive element and motor characteristics.

On the left side of the development gears 122Y, 122C, 122M, and 122K, first relay gears 125Y, 125C, 125M, and 125K are provided. The first relay gears 125Y, 125C, 125M, and 125K rotate in engagement with fixed shafts, not shown, by meshing with the second gear portions 124Y, 124C, 124M, and 124K and receiving rotary drive forces from the development gears 122Y, 122C, 122M, and 122K. With the first relay gears 125Y, 125C, 125M, and 125K, the second gear portions 124Y, 124C, 124M, and 124K are meshed on the upstream side relative to the direction of drive transmission and clutch input gears 126Y, 126C, 126M, and 126K are meshed on the downstream side relative to the direction of drive transmission. The clutch input gears 126Y, 126C, 126M, and 126K are supported by development clutches 127Y, 127C, 127M, and 127K, respectively, that engage clutch shafts to transmit the rotary drive forces of the clutch input gears 126Y, 126C, 126M, and 126K to the clutch shafts or allow the clutch input gears 126Y, 126C, 126M, and 126K to idle according to on/off control of power supply by a control unit, not shown. On each end of the clutch shafts of the development clutches 127Y, 127C, 127M, and 127K, clutch output gears 128Y, 128C, 128M, and 128K are fixed, respectively. When power is supplied to the development clutches 127Y, 127C, 127M, and 127K, the rotary drive forces of the clutch input gears 126Y, 126C, 126M, and 126K are transmitted to the clutch shafts so that the clutch output gears 128Y, 128C, 128M, and 128K rotate. When the power supply to the development clutches 127Y, 127C, 127M, and 127K is cut, the process drive motors 120Y, 120C, 120M, and 120K may be rotating, however, the clutch input gears 126Y, 126C, 126M, and 126K idle on the clutch shafts so that rotation of the clutch output gears 128Y, 128C, 128M, and 128K comes to a stop.

On the right side of the clutch output gears 128Y, 128C, 128M, and 128K, second relay gears 129Y, 129C, 129M, and 129K are provided, respectively. The second relay gears 129Y, 129C, 129M, and 129K may rotate in engagement with fixed shafts, not shown, by meshing with the clutch output gears 128Y, 128C, 128M, and 128K.

Figure 9:
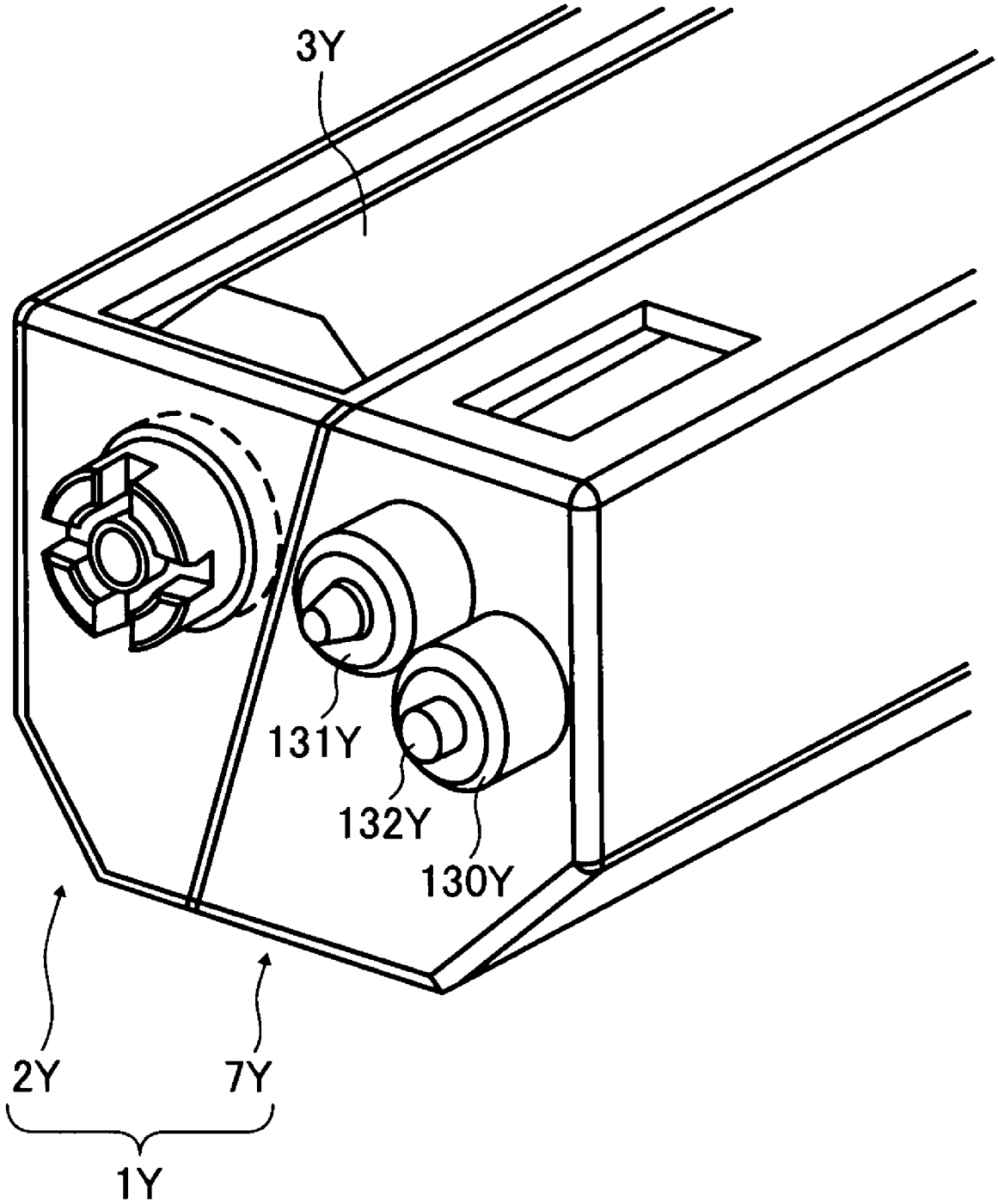
FIG. 9 is a perspective view illustrating one end of the process unit.

FIG. 9 is a perspective view illustrating one end of the process unit 1Y. The shaft member of the development sleeve 15Y included in the casing of the development unit 7Y pierces the side of the casing and protrudes therefrom. To the protruding shaft member, a sleeve upstream gear 131Y is fixed. A fixed shaft 132Y also protrudes from the side of the casing. A third relay gear 130Y is meshed with the sleeve upstream gear 131Y while rotatably engaging the fixed shaft 132Y.

When the process unit 1Y is installed in the printer, the sleeve upstream gear 131Y and the second relay gear 129Y of FIGS. 7 and 8 are meshed with the third relay gear 130Y. The rotary drive force of the second relay gear 129Y is sequentially transmitted to the third relay gear 130Y and the sleeve upstream gear 131Y, thereby rotating the development sleeve 15Y.

It should be noted that although only the process unit 1Y is described with reference to the drawings, rotary drive forces are transmitted to the development sleeves in the process units 1C, 1M, and 1K in the same way as described above with respect to the process unit 1Y.

Although only one end of the process unit 1Y is illustrated in FIG. 9, the other end of the shaft member of the development sleeve 15Y pierces the other side of the casing and protrudes therefrom. A sleeve downstream gear, not shown, is fixed to the protrusion. The shaft members of the first conveying screw 8Y and the second conveying screw 11Y also pierce the other side of the casing and protrude therefrom. A first screw gear, not shown, and a second gear, not shown, are fixed to the protrusions, respectively. When the development sleeve 15Y is rotated by drive transmission by the sleeve upstream gear 131Y, the sleeve downstream gear is rotated at the other end side. The second conveying screw 11Y is rotated by receiving the drive force with the second screw gear that meshes with the sleeve downstream gear, and the first conveying screw 8Y is rotated by receiving the drive force with the first screw gear that meshes with the second screw gear. The process units 1C, 1M, and 1K have the same configuration.

Figure 10:
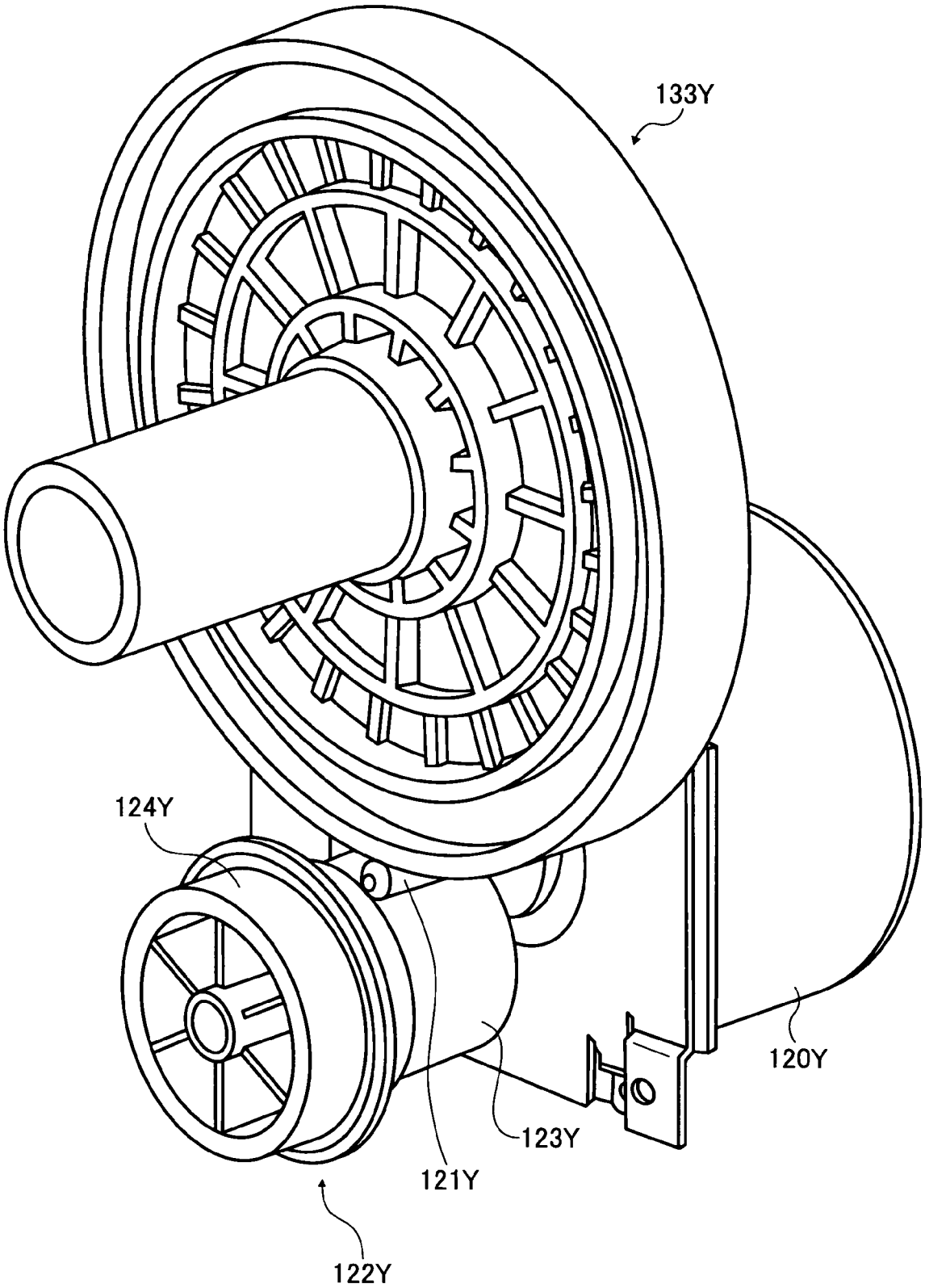
FIG. 10 is a perspective view illustrating a photosensitive element gear and peripheral components included in the printer.

FIG. 10 is a perspective view illustrating the photosensitive element gear 133Y and peripheral components included in the printer. The first gear portion 123Y in the development gear 122Y and the photosensitive element gear 133Y, which is a driven gear, mesh with the drive gear 121Y fixed to the motor shaft of the process drive motor 120Y. The photosensitive element gear 133Y is rotatably supported by the drive transmission unit and has a larger diameter than that of the photosensitive element. When the process drive motor 120Y rotates, the rotary drive force is transmitted from the drive gear 121Y to the photosensitive element gear 133Y via a single step reduction to rotate the photosensitive element. The process units 1C, 1M, and 1K have the same configuration.

The rotation shaft of the photosensitive element in the process unit and the photosensitive element gear supported in the printer are connected by a coupling.

In the printer having the above-described configuration, the photosensitive element gear 133Y is rotated by the process drive motor 120Y and the velocity of the photosensitive element 3Y may fluctuate due to an eccentricity of the photosensitive element gear 133Y. The velocity varies in sine wave form with a cycle of a rotation lap of the photosensitive element 3Y.

Referring to FIG. 3, fluctuation in the linear velocity of each of the photosensitive elements 3Y, 3C, 3M, and 3K causes fluctuation in the time taken for the latent image formed on each of the photosensitive elements 3Y, 3C, 3M, and 3K to move from the position irradiated with light by the optical writing unit 20 to the primary transfer nip via development of the latent image. As a result, the images are subtly displaced on top of each other at the primary transfer nips.

Figure 11:
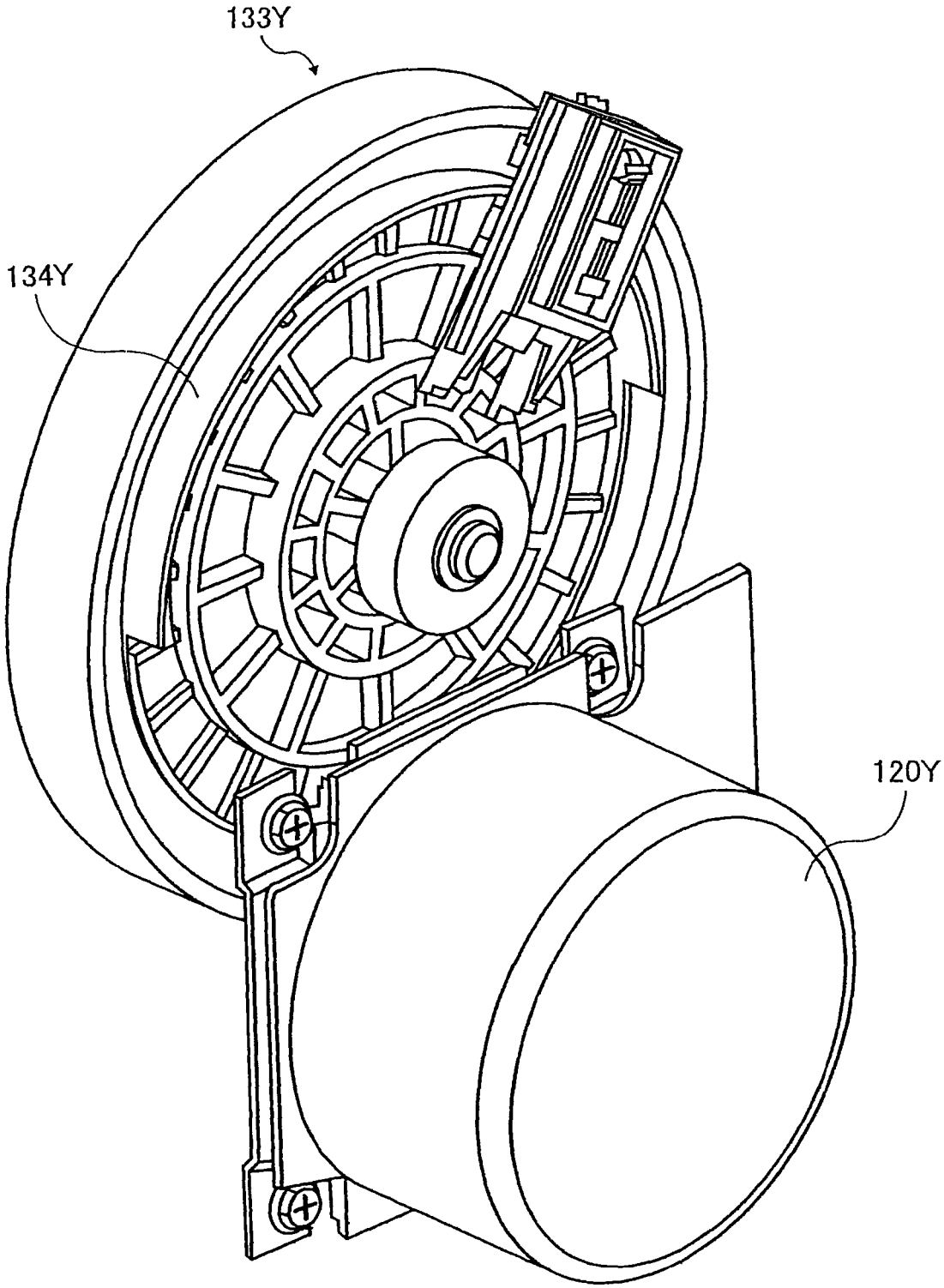
FIG. 11 is a perspective view illustrating the photosensitive element gear and the peripheral components included in the printer as viewed from a process drive motor side.
Figure 12:
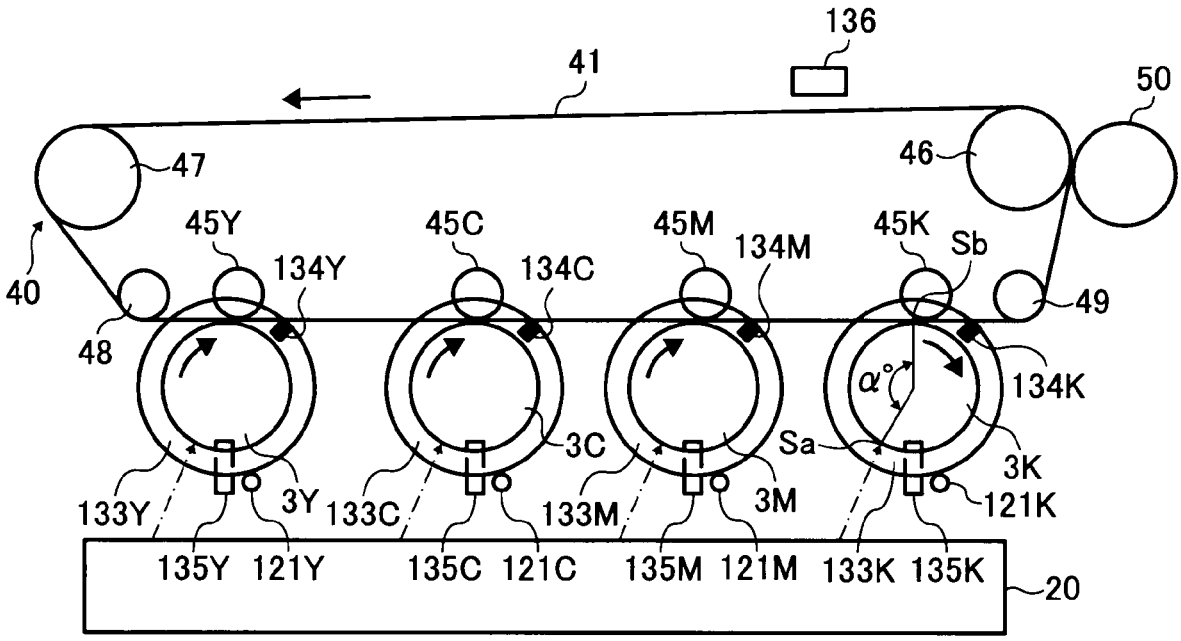
FIG. 12 is a side view illustrating four photosensitive elements, a transfer unit, and an optical writing unit included in the printer.

FIG. 11 is a perspective view illustrating the photosensitive element gear 133Y and the peripheral components thereof as viewed from the process drive motor, and FIG. 12 is a side view illustrating the photosensitive elements 3Y, 3C, 3M, and 3K, the transfer unit 40, and the optical writing unit 20. A marking blade member 134Y protrudes at a particular position in the direction of rotation of the gear portion of the photosensitive element gear 133Y. On the side of the photosensitive element gear 133Y, a position sensor 135Y is provided. When the rotation of the photosensitive element gear 133Y arrives at a particular angle, the blade member 134Y thereof is located facing the position sensor 135Y and detected by the position sensor 135Y. Therefore, every timing of when the rotation of the photosensitive element gear 133Y arrives at a particular angle is detected by the position sensor 135Y during rotation.

Thus, the blade members 134Y, 134C, 134M, and 134K, which are provided to the photosensitive element gears 133Y, 133C, 133M, and 133K rotating coaxially with the photosensitive elements 3Y, 3C, 3M, and 3K, respectively, are detected by the position sensors 135Y, 135C, 135M, and 135K every time the photosensitive element gears 133Y, 133C, 133M, and 133K rotate. The position sensors 135Y, 135C, 135M, and 135K are formed of, for example, photosensors.

Above the transfer unit 40, an optical sensor unit 136 formed of two reflective photosensors, not shown, arranged at a particular interval in the width direction of the intermediate transfer belt 41 is provided facing the upper stretched surface of the intermediate transfer belt 41, with a particular gap therebetween.

A control unit, not shown, of the printer controls detection of fluctuation in linear velocity of each photosensitive element caused by an eccentricity of the photosensitive element gear to detect the velocity fluctuation pattern per rotation lap of the photosensitive element gear. The control unit performs such control when an operation that changes the velocity fluctuation pattern is made, for example, when the process unit is replaced, when a print command is issued in a print mode for high quality image, etc.

Figure 13:
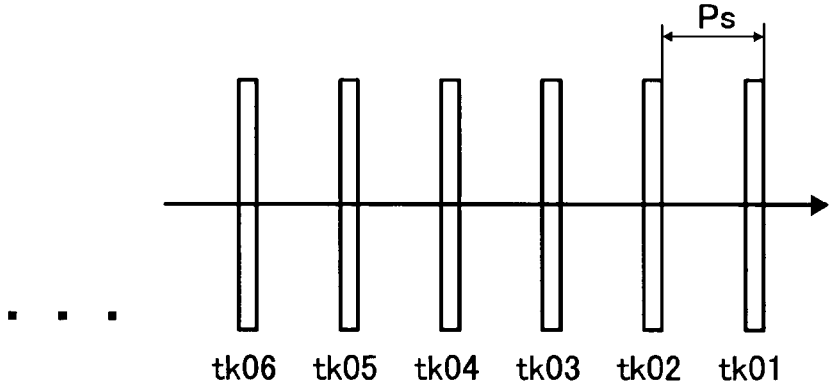
FIG. 13 is a diagram illustrating detection toner images for K formed in the printer.

The control of the fluctuation pattern detection includes forming detection images on each of the photosensitive elements 3Y, 3C, 3M, and 3K and transferring the detection images to the intermediate transfer belt 41, such that the detection images are not superimposed one atop another. As illustrated in FIG. 13, for example, a detection image PVk for K includes a plurality of K detection toner images tk01, tk02, tk03, tk04, tk05, tk06, etc. that are transferred to and arranged on the intermediate transfer belt 41 at a particular pitch Ps in the direction of movement of the intermediate transfer belt 41 (sub-scanning direction) indicated by an arrow in FIG. 13. It should be noted that although the detection toner images are arranged at a particular pitch in theory, in practice, however, the pitch between the K toner images varies according to the fluctuation in the velocity of the photosensitive element 3K.

Referring to FIG. 3, each detection toner image formed on the intermediate transfer belt 41 passes through a position facing the secondary transfer roller 50 while being conveyed to a position facing the optical sensor unit 136 according to the endless movement of the intermediate transfer belt 41. Before the toner image passes through the position facing the secondary transfer roller 50, the secondary transfer roller 50 is separated from the intermediate transfer belt 41 by a roller separation mechanism, not shown, to prevent the detection toner from being transferred to the secondary transfer roller 50.

Each detection toner image is detected by the optical sensor unit 136 when passing under the optical sensor unit 136 with the movement of the intermediate transfer belt 41. Therefore, the variation in the detection time interval between the detection toner images is detected for each color. The variation in the detection time interval corresponds to the fluctuation in the velocity of the photosensitive element caused by the eccentricity of the photosensitive element gear.

The control unit, not shown, of the printer analyzes the velocity fluctuation pattern per rotation lap of each photosensitive element gear based on the above-described variation in the detection time interval and one rotation cycle of the photosensitive element gear. The velocity fluctuation pattern can be analyzed by analyzing amplitude and phase of the fluctuation component from a zero cross point or a peak value of the fluctuation by assuming that an average of all data is zero. However, this method is impractical in that the variation increases because the detected data is greatly affected by noise. Therefore, the printer employs an orthogonal detection method to analyze the velocity fluctuation pattern. The orthogonal detection allows analysis of the velocity fluctuation pattern with a small amount of fluctuation data, which is difficult with calculation by detection of a zero cross point or a peak value of the fluctuation.

In the printer, the phase of the waveform of the velocity fluctuation pattern of the photosensitive element gear is synchronized with that of the velocity fluctuation pattern of the photosensitive element with a little difference in amplitude. Therefore, the velocity fluctuation pattern of the photosensitive element can be detected by detecting the velocity fluctuation pattern of the photosensitive element gear.

Figure 14:
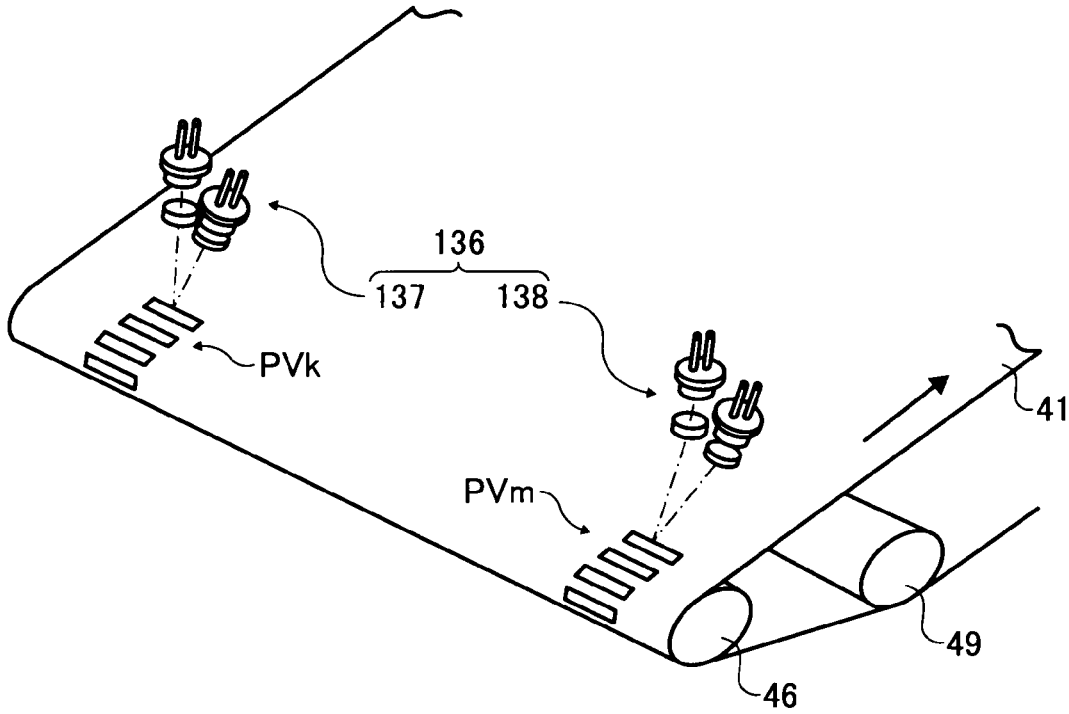
FIG. 14 is a perspective view illustrating the transfer unit and an optical sensor unit.

As illustrated in FIG. 14, the detection image PVk for K and the detection image PVm for M are formed at both ends of the intermediate transfer belt 41 in the width direction thereof to reduce the time taken for controlling the fluctuation pattern detection. Specifically, the detection image PVk formed at one end in the width direction of the intermediate transfer belt 41 is detected by a first optical sensor 137 included in the optical sensor unit 136 and the detection image PVm formed at the other end in the width direction of the intermediate transfer belt 41 is detected by a second optical sensor 138 included in the optical sensor unit 136. Accordingly, the variation in the detection time interval between the K detection toner images in the detection image PVk and the variation in the detection time interval between the M detection toner images in the detection image PVm are simultaneously detected. Therefore, the time taken for controlling the fluctuation pattern detection is reduced. In the same way, the variation in the detection time interval for Y and the variation in the detection time interval for C are simultaneously detected.

After detecting the velocity fluctuation pattern per rotation lap of each photosensitive element gear by controlling the fluctuation pattern detection, the control unit of the printer analyzes a drive velocity pattern to cancel the fluctuation in the velocity of the photosensitive element gear for each color. The detected velocity fluctuation pattern is different from the actual velocity fluctuation pattern of the photosensitive element gear, which is described below.

Figure 15:
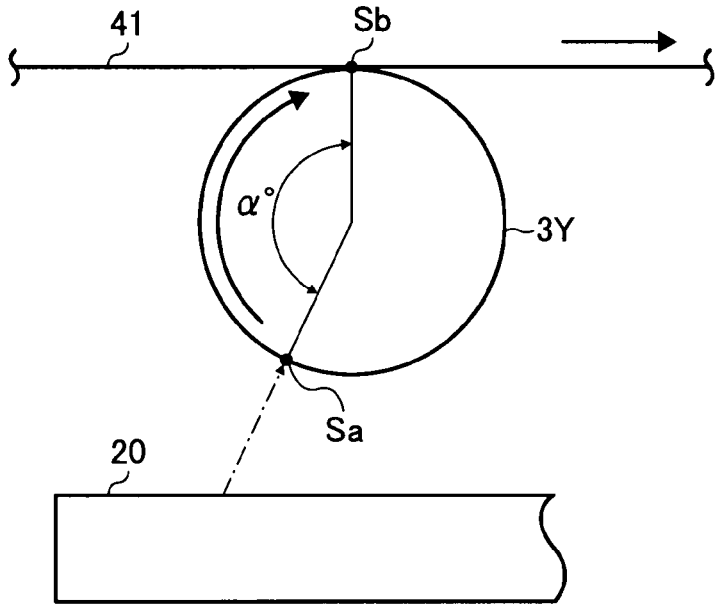
FIG. 15 is a diagram for illustrating a relation between a writing position of latent images and a transfer position of toner images.

Referring to FIG. 15, the latent electrostatic image for Y is formed on the photosensitive element 3Y by irradiation of light from the optical writing unit 20. On the rotational trajectory of the photosensitive element 3Y, the position where the latent image is formed by the light from the optical writing unit 20 is indicated by Sa, which is referred to as a writing position Sa. The position where the toner image for Y is transferred to the intermediate transfer belt 41 is indicated by Sb, which is referred to as a transfer position Sb.

Figure 16:
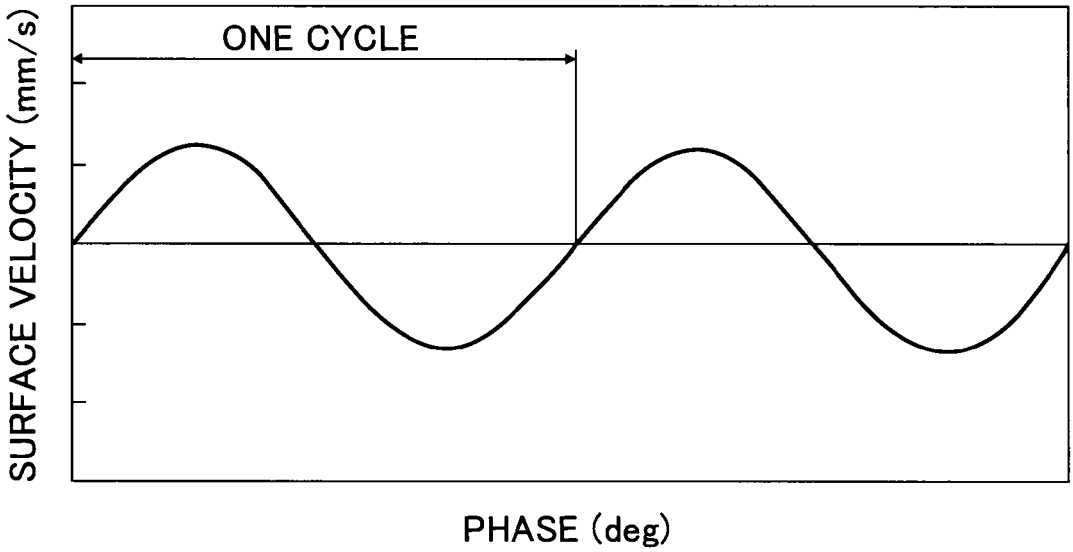
FIG. 16 is a graph illustrating fluctuation in velocity of the photosensitive element at the writing position.
Figure 17:
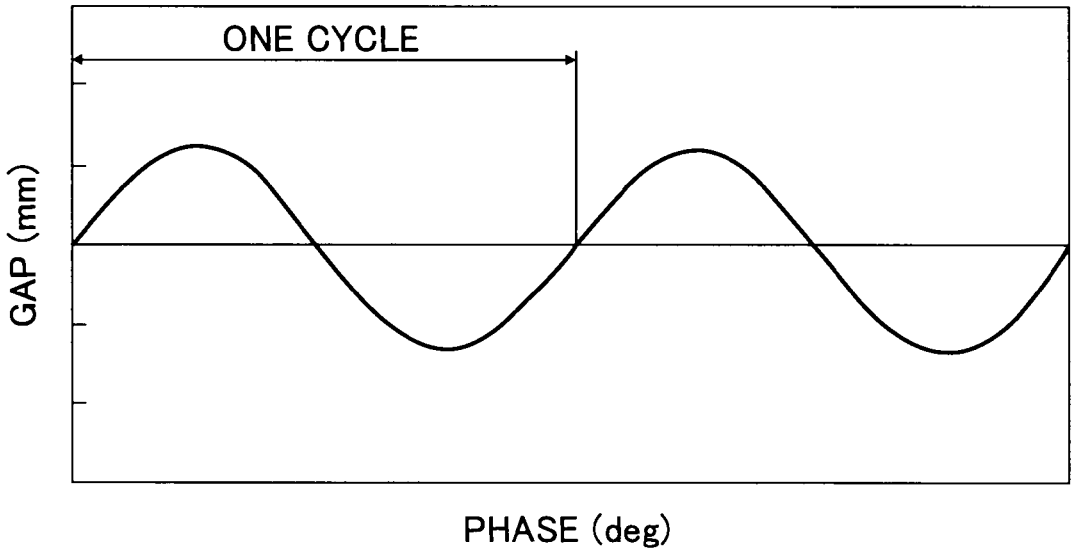
FIG. 17 is a graph illustrating fluctuation in gap between the latent images at the writing position.

It is preferable to form the Y detection toner images at equal intervals in the circumferential direction of the photosensitive element 3Y. Therefore, the light for forming each Y latent image, which is a precursor of the Y toner image, is emitted at equal intervals. When the velocity of the photosensitive element 3Y fluctuates, the gap (distance) between the Y latent images varies according to the fluctuation in the velocity. Specifically, when the surface of the photosensitive element 3Y moves faster than usual at the writing position Sa, the gap between the Y latent images is increased. When the surface of the photosensitive element 3Y moves slower than usual, the gap between the Y latent images is reduced. Therefore, when the surface velocity of the photosensitive element 3Y fluctuates at the writing position Sa as illustrated in FIG. 16, the gap between the Y latent images fluctuates as illustrated in FIG. 17. As can be seen in FIGS. 16 and 17, the fluctuation in the velocity and the fluctuation in the gap between the Y latent images are in phase with each other.

Figure 18:
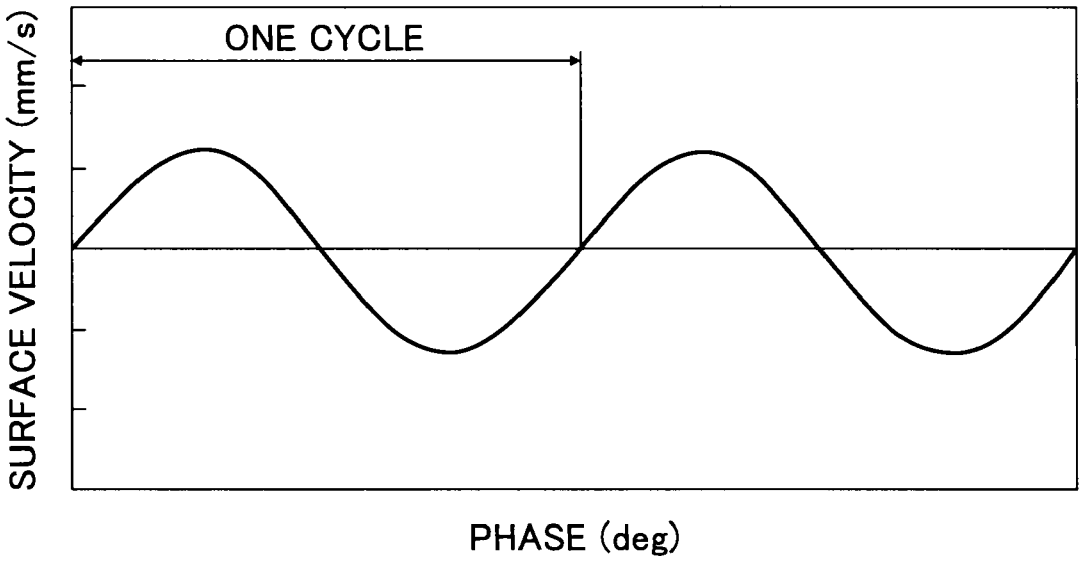
FIG. 18 is a graph illustrating fluctuation in velocity of the photosensitive element at the transfer position.
Figure 19:
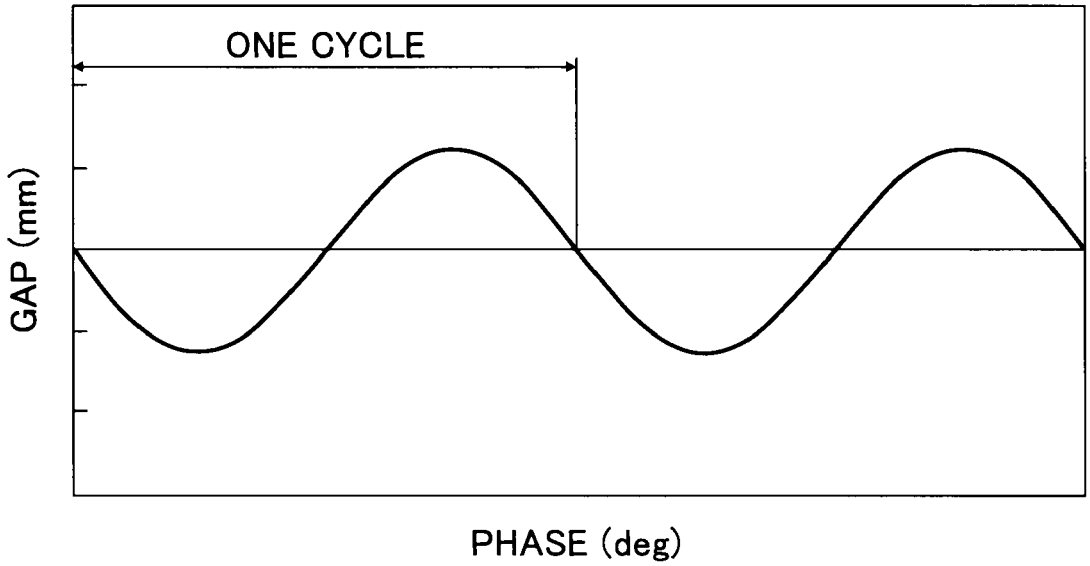
FIG. 19 is a graph illustrating fluctuation in gap between the toner images at the transfer position.

When the velocity of the photosensitive element 3Y fluctuates during primary transfer of the Y toner images obtained by developing the Y latent images to the intermediate transfer belt 41, the Y toner images, which may be formed on the photosensitive element 3Y at equal intervals, are transferred to the intermediate transfer belt 41 at unequal intervals. When the surface of the photosensitive element 3Y moves faster than usual at the transfer position Sb, the gap between the Y toner images on the intermediate transfer belt 41 is reduced. When the surface of the photosensitive element 3Y moves slower than usual, the gap between the Y toner images on the intermediate transfer belt 41 is increased. Therefore, when the surface velocity of the photosensitive element 3Y fluctuates at the transfer position Sb as illustrated in FIG. 18, the gap between the Y toner images on the intermediate transfer belt 41 fluctuates as illustrated in FIG. 19. As can be seen in FIGS. 18 and 19, the fluctuation in the velocity and the fluctuation in the gap between the Y toner images are 180 degrees out of phase with each other.

Figure 20:
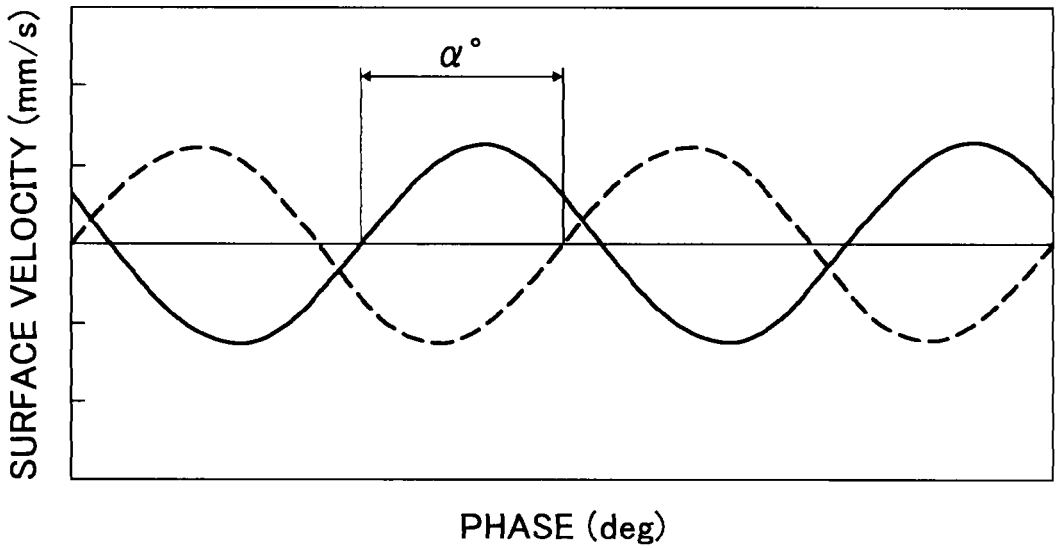
FIG. 20 is a graph illustrating relation between fluctuation in velocity of the photosensitive element at the writing position and fluctuation in velocity of the photosensitive element at the transfer position.
Figure 21:
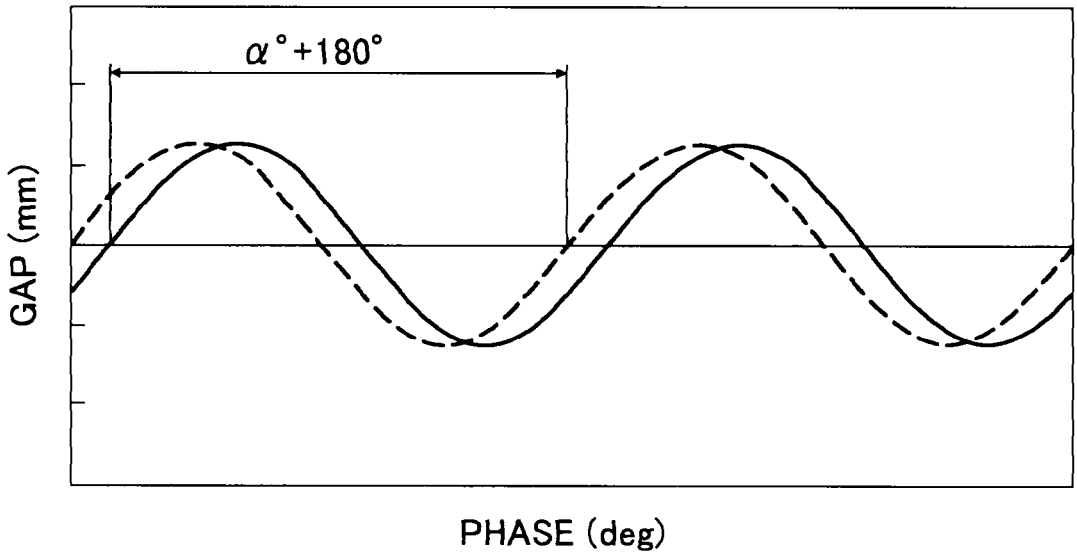
FIG. 21 is a graph illustrating relation between fluctuation in gap between the latent images at the writing position and fluctuation in gap between the toner images at the transfer position.

As a result, fluctuation caused by the fluctuation in the surface velocity of the photosensitive element at the writing position Sa and fluctuation caused by the fluctuation in the surface velocity of the photosensitive element at the transfer position Sb are overlapped to produce the variation in the gap between the Y detection toner images on the intermediate transfer belt 41. Specifically, referring to FIG. 15, an angle between the writing position Sa and the transfer position Sb to the center of the photosensitive element 3Y is assumed to be $\alpha°$. Then, as illustrated in FIG. 20, the phase of the fluctuation in the surface velocity of the photosensitive element at the writing position Sa indicated by the dashed line and the phase of the fluctuation in the surface velocity of the photosensitive element at the transfer position Sb indicated by the continuous line are $\alpha°$ out of phase. The velocity-gap relation is reversed when the toner image is transferred. Therefore, as illustrated in FIG. 21, the fluctuation in the gap between the Y latent images indicated by the dashed line and the fluctuation in the gap between the Y toner images on the intermediate transfer belt 41 indicated by the continuous line are $180+\alpha°$ out of phase.

Figure 22:
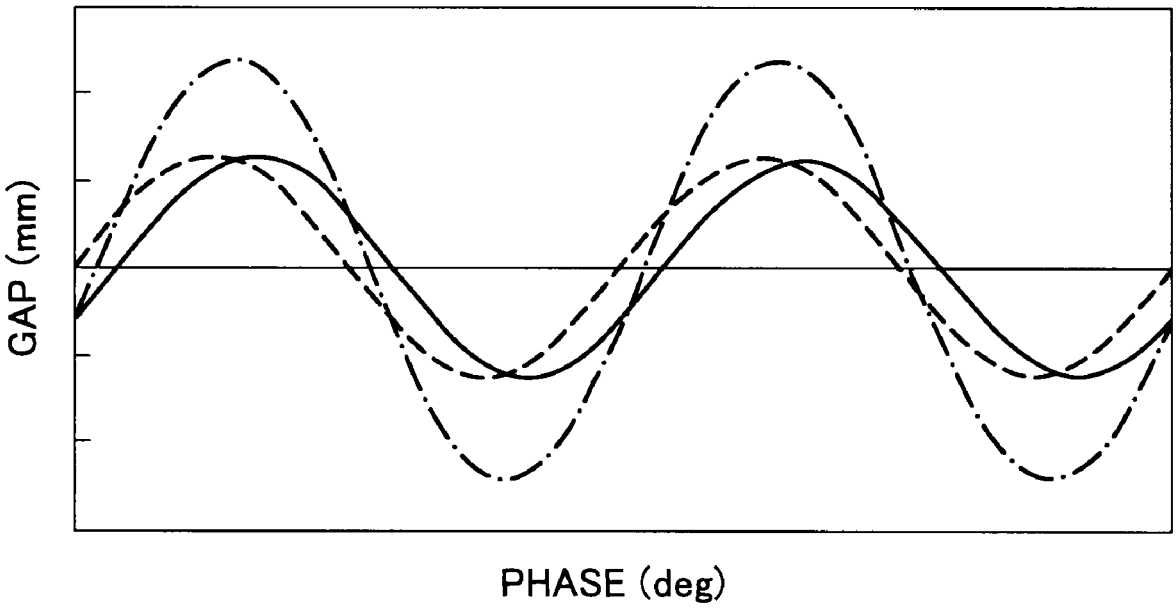
FIG. 22 is a graph illustrating a variation in the gap between the detection toner images.

Therefore, the fluctuation in the gap between the latent images at the writing position Sa and the fluctuation in the gap between the toner images at the transfer position Sb are overlapped to produce the variation in the gap between the toner images. Therefore, the variation in the gap between the toner images, which is detected based on the variation in the detection time interval of each detection toner image, has a composite waveform of the two characteristic waveforms indicated by a dashed dotted line in FIG. 22. The fluctuation in the gap between the latent images at the writing position Sa, i.e. the actual velocity fluctuation pattern of the photosensitive element gear, can be analysed based on the phase and amplitude of the composite waveform and the $180+\alpha°$ out of phase relation by a known analysis method. By driving the process drive motor according to the drive velocity pattern that is in the opposite phase to the fluctuation in the gap between the latent images, the fluctuation in the velocity of the photosensitive element can be reduced.

Prior to the analysis of the drive velocity pattern, the angle of rotation of the photosensitive element gear at the start of the waveform of the fluctuation in the gap between the latent images, which is a point of starting to form a latent image corresponding to a leading end of the detection toner images, is identified. The control unit of the printer determines a timing of starting forming the latent images for the detection toner images of each color based on the time (gear angled time) at which the blade member of the corresponding photosensitive element gear is detected by the position sensor.

The determination of the timing of starting forming the latent images is now described. The control unit starts forming the latent images for the detection toner images of each color after a period of time t1 from the gear angled time, which is referred to as latent image formation start time. In other words, the latent image formation start time is the gear angled time plus the period of time t1. Therefore, the waveform of the fluctuation in the gap between the latent images at the writing position Sa (the actual velocity fluctuation pattern of the photosensitive element gear) starts at the time after the period of time t1 from when the position sensor detects the blade member of the photosensitive element gear. By using the start of the waveform as a reference to drive the process drive motor according to the drive velocity pattern, which is in the opposite phase to the waveform of the fluctuation in the gap between the latent images at the writing position Sa, the fluctuation in the velocity of the photosensitive element caused by the eccentricity can be reduced by the fluctuation in the driving velocity.

When the printer forms an image using image information sent from, for example, a personal computer, the process drive motor for each color is controlled based on a pre-analyzed drive velocity pattern and the gear angled time transmitted from the position sensor.

Figure 2:
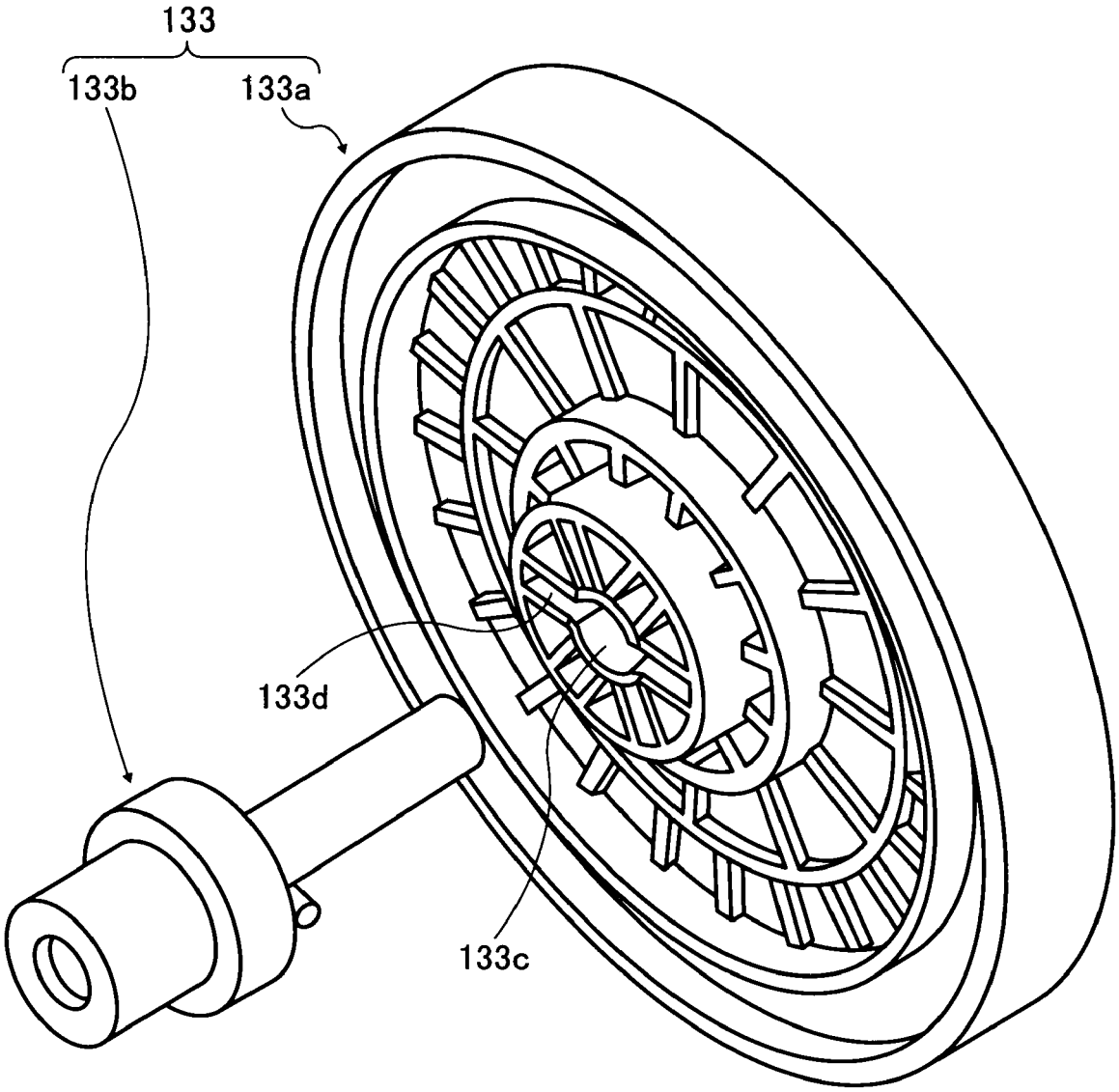
FIG. 2 BACKGROUND ART
FIG. 2 is an exploded perspective view of the photosensitive element gear shown in FIG. 1.

However, this technique may not sufficiently reduce the fluctuation in the velocity of the photosensitive element for each color in a typical image forming apparatus, for the reason described with respect to FIG. 1 and FIG. 2 described above.

More specifically, as described above the slight rattling movement produced between the gear portion 133*a* and the engaging portion 133*b* inserted thereto due to an error in the dimensional accuracy of the gear portion 133*a* or the engaging portion 133*b* causes the velocity fluctuation pattern of the photosensitive element gear 133 per rotation to vary slightly from rotation to rotation. As a result, the drive velocity pattern detected based on the predetermined detection toner images does not match the velocity fluctuation pattern during image formation, which causes a mismatch between the drive velocity pattern that is analyzed in the above-described manner and the actual velocity fluctuation pattern of the photosensitive element gear 133 and prevents reduction of fluctuation in the velocity of the photosensitive element gear 133.

FIG. 23 is a perspective view illustrating the photosensitive element gear 133Y included in the printer of the present invention. The photosensitive element gear 133Y includes a disk-like gear portion 133*a*Y and a tubular engaging portion 133*b*Y that are formed of the same material, for example, a resin material, and seamlessly integrated with each other. In each of the photosensitive element gear 133C, 133M, or 133K, the gear portion and the engaging portion are similarly integrated with each other to form a single unit.

In the printer, each of the photosensitive element gear 133Y, 133C, 133M, and 133K includes the disk-like gear portion having a geared circumference and the engaging portion engaging the photosensitive element. The gear portion and the engaging portion are integrated with each other to form a single unit, and thus there is no rattling therebetween. As a result, any mismatch between the velocity fluctuation pattern detected based on the detection toner images and the actual velocity fluctuation pattern during image formation is prevented, and therefore degradation of superimposition accuracy caused by such rattling is prevented.

The engaging portion 133*b*Y of the photosensitive element gear 133Y illustrated in FIG. 23 is a female component that has a concave portion for receiving the coupling of the photosensitive element. The concave portion of the female engaging portion 133*b*Y can be in the form of, for example, a polygonal prism such as a triangular prism or a quadrangular prism that fits the outside diameter of the coupling, not shown. However, the concave portion in the form of a polygonal prism has a relatively small number of mesh points with the coupling, and a mesh error tends to cause fluctuation in transmission velocity. Therefore, in the printer, the female engaging portion 133*b*Y has an inner geared circumference in its cylindrical concave portion and the coupling is a male component with gears meshed with the inner gears of the engaging portion 133*b*Y. With this configuration, fluctuation in transmission velocity caused by a mesh error can be reduced by increasing the mesh points as compared with an engaging portion with the concave portion in the form of polygonal prism. Alternatively, a female coupling and a male engaging portion 133*b*Y can be used, that is, the engaging portion 133*b*Y is a male component and the coupling is a female component with a concave portion that receives the engaging portion 133*b*Y.

In the printer in which the photosensitive element gear includes the gear portion and the engaging portion that are integrated with each other, the velocity fluctuation pattern of the photosensitive element is changed only when an angle of engagement in the direction of rotation between the rotation shaft of the photosensitive element and the engaging portion of the photosensitive element gear is changed by attachment, detachment, or replacement of the process unit. Therefore, it is preferable to configure the control unit to control the fluctuation pattern detection only when the attachment or detachment of the process unit is detected, thereby enabling unnecessary downtime to be eliminated by avoiding unnecessary control of the fluctuation pattern detection.

Although the description given above is of the velocity fluctuation pattern per rotation lap of the photosensitive element, the velocity of the photosensitive element may fluctuate periodically in a cycle longer than one rotation lap, which is a cycle of $2\Pi/\omega\times(\alpha\times360)$ seconds, where $\omega$ is an angular velocity of the photosensitive element. By providing each detection toner image such that the detection toner image is detected for a period of time longer than the cycle of the fluctuation, the periodical fluctuation in the velocity with a cycle longer than one cycle can be detected, and therefore the velocity can be controlled based on a pattern longer than one cycle.

Next, examples of printers having additional characteristics are now described. The printers described in the following examples have the same configuration as that of the above-described embodiment, unless otherwise specified.

In the printer according to a first example of the present invention, as the latent image formation start time of the detection toner image for each color, the control unit uses the corresponding gear angled time, which is the time when the position sensor detects the blade member of the photosensitive element gear. In other words, the above-described period of time t1 is zero μsec, thereby enabling the operation of adding the period of time t1 to the gear angled time to identify the start time of the drive velocity pattern to be omitted.

In the printer according to a second example of the present invention, when an image is formed using image information, the control unit determines, for each process drive motor of each color, whether or not to adjust the driving velocity of the process drive motor according to the pre-analyzed drive velocity pattern based on a maximum fluctuation in the velocity fluctuation pattern of the photosensitive element gear. Specifically, when the maximum fluctuation in the velocity fluctuation pattern of the photosensitive element gear is at or below a threshold value, the driving velocity of the process drive motor is not adjusted but the process drive motor is driven at a constant velocity to form an image using image information. When the maximum fluctuation in the velocity is at or above the threshold value, the driving velocity of the process drive motor is adjusted according to the drive velocity pattern.

The reason for performing such control is now described. There is a difference between the time when the blade member of the photosensitive element gear is detected by the position sensor (gear angled time) and the time when the photosensitive element gear is actually rotated at the particular angle, because there are limits to detection accuracy of the position sensor and variations in rotation of the process drive motor. Accordingly, a slight fluctuation remains in the linear velocity of the photosensitive element even after the driving velocity of the process drive motor is adjusted according to the drive velocity pattern. When there is little fluctuation in the actual velocity of the photosensitive element, the adjustment of the driving velocity according to the drive velocity pattern may actually increase the fluctuation in the velocity of the photosensitive element due to the above-described causes compared to a case in which the fluctuation in the velocity of the photosensitive element is not adjusted. Therefore, when the maximum fluctuation in the velocity fluctuation pattern is at or below the threshold value, the driving velocity of the process drive motor is not adjusted but the process drive motor is driven at a constant velocity, thereby avoiding any increase in the fluctuation in the velocity of the photosensitive element generated by such adjustment.

In the printer according to a third example of the present invention, when detecting the velocity fluctuation pattern for each photosensitive element gear of each color, the control unit calculates a period of time from when the position sensor detects the blade member of the photosensitive element gear to when the position sensor detects the next blade member. The calculation result is stored in the RAM as a reference time taken for the rotation lap of the photosensitive element gear.

When an image is formed using image information, the control unit calculates the time taken for the rotation lap of each photosensitive element gear of each color and an average of the calculated time. When the difference between the average and the reference time previously stored in the RAM is at or above a threshold value, the pre-analyzed drive velocity pattern is corrected. Further, after updating the reference time to the same value as the average, the driving velocity of the process drive motor is adjusted according to the corrected drive velocity pattern.

The reason for performing such control is now described. As described above, the drive velocity pattern is analyzed based on the detection result of the velocity fluctuation pattern only when the velocity fluctuation pattern of the photosensitive element is changed due to, for example, replacement of the process unit. Therefore, the time interval for updating the drive velocity pattern is relatively long. During such a time interval, the time taken for the rotation lap of the photosensitive element gear may be changed due to, for example, degradation of the process drive motor or brief fluctuations in the output voltage from a motor power supply. When the driving velocity of the process drive motor is adjusted based on the drive velocity pattern corresponding to the unadjusted time taken for the rotation lap of the photosensitive element gear, the fluctuation in the velocity of the photosensitive element is not sufficiently reduced. Therefore, when the difference between the average time taken for the rotation lap of the photosensitive element gear and the reference time taken for the rotation lap is at or above the threshold value, the drive velocity pattern is corrected according to the average. Specifically, the uncorrected waveform of the drive velocity pattern is expanded or shrunk in the time axis direction to have one cycle of the average time. Consequently, increase in the amount of fluctuation in the velocity of the photosensitive element, which is caused by an inappropriate drive velocity pattern due to fluctuation in the time taken for the rotation lap of the photosensitive element gear, is reduced.

Although the description given above is of the printer that adjusts the driving velocity of the process drive motor according to the drive velocity pattern, the photosensitive element gear that includes the gear portion and the engaging portion that are integrated with each other to form a single unit can also be applied to an image forming apparatus that adjusts the phase of the velocity fluctuation pattern of each photosensitive element.

In each printer according to the embodiment and each of the examples, the control unit serving as a controller is configured to detect the velocity fluctuation pattern per rotation lap of the surface of the photosensitive element serving as an image bearing member. Therefore, the velocity fluctuation pattern per rotation lap of the photosensitive element fluctuating due to an eccentricity of the photosensitive element gear, which is a driven gear, is detected.

In each printer according to the embodiment and each of the examples, each of the position sensors 135Y, 135C, 135M, and 135K serving as a rotation angle detection unit is provided to detect when rotation of each of the plurality of photosensitive element gears 133Y, 133C, 133M, and 133K arrives at a particular angle, respectively. The control unit is configured to perform control to determine a timing of starting forming each of the detection toner images for Y, C, M, and K on the photosensitive elements 3Y, 3C, 3M, and 3K, respectively, based on the detection results of the position sensors 135Y, 135C, 135M, and 135K. Therefore, the start time of the velocity fluctuation pattern and the drive velocity pattern are identified based on the gear angled time detected by each of the position sensors 135Y, 135C, 135M, and 135K, and therefore, the driving velocity of each of the process drive motors 120Y, 120C, 120M, and 120K is sufficiently adjusted.

In the printer according to the first example, the time when the photosensitive element gear is rotated at the particular angle (the gear angled time) is adopted as the latent image formation start time. Therefore, the operation of adding the period of time t1 to the gear angled time to identify the start time of the drive velocity pattern can be omitted.

As described above, the control unit is configured to perform control for each of the plurality of the photosensitive elements 3Y, 3C, 3M, and 3K to analyze the drive velocity pattern of each of the process drive motors 120Y, 120C, 120M, and 120K that cancels the fluctuation in the surface velocity of the photosensitive element based on the latent image formation start time and the velocity fluctuation pattern, and adjust the driving velocity of each of the process drive motors 120Y, 120C, 120M, and 120K based on the results of that analysis. Therefore, fluctuation in the surface velocity of the photosensitive element caused by the eccentricity of the photosensitive element gear is cancelled by the fluctuation in the driving velocity of the process drive motor, thereby reducing fluctuation in the surface velocity of the photosensitive element and resultant image displacement.

In the printer according to the second example, the control unit is configured to perform control for each of the plurality of process drive motors 120Y, 120C, 120M, and 120K not by adjusting the driving velocity of the process drive motor according to the drive velocity pattern but by driving the process drive motor at a constant velocity when the maximum fluctuation in the velocity fluctuation pattern corresponding to the process drive motor is at or below a threshold value. Therefore, any increase in fluctuation in the velocity of the photosensitive element, which is caused by adjustment of the driving velocity of the process drive motor, is prevented.

In the printer according to the third example, the control unit is configured to perform control for each of the plurality of photosensitive element gears 133Y, 133C, 133M, and 133K to calculate a time taken for the rotation lap of the photosensitive element gear at a particular timing based on the detection result of each of the position sensors 135Y, 135C, 135M, and 135K and correct the drive velocity pattern according to the calculation result. Therefore, any increase in the amount of fluctuation in the velocity of the photosensitive element, which is caused by an inappropriate drive velocity pattern due to fluctuation in the time taken for the rotation lap of the photosensitive element gear, is reduced.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program or computer program product. For example, the aforementioned methods may be embodied in the form of a system or device, including, but not limited to, any of the structures for performing the methodology illustrated in the drawings.

Any of the aforementioned methods may be embodied in the form of a program. The program may be stored on a computer-readable medium and adapted to perform any one of the aforementioned methods when run on a computer device (a device including a processor). The program may include computer-executable instructions for carrying out one or more of the steps above, and/or one or more of the aspects of the invention. Thus, the storage medium or computer-readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetic storage media, including but not limited to floppy disks (trademark), cassette tapes, and removable hard disks; media with a built-in rewriteable non-volatile memory, including but not limited to memory cards; and media with a built-in ROM, including but not limited to ROM cassettes, etc. Furthermore, various information regarding stored images, for example, property information, may be stored in any other form, or provided in other ways.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus, comprising:

a plurality of image bearing members which bears visible images on rotating surfaces thereof;

a plurality of drive sources which individually drives the image bearing members, each of the plurality of drive sources comprising a drive gear;

a plurality of driven gears which individually engages the image bearing members on rotation axes of the image bearing members and mesh with the drive gears;

a visible image forming unit which forms the visible images on each of the image bearing members based on image information;

an endless traveling member which endlessly moves a surface thereof to sequentially pass positions facing the image bearing members;

a transfer unit which transfers the visible images formed on each of the surfaces of the image bearing members to a recording medium held on the surface of the endless traveling member, or to the surface of the endless traveling member and to the recording medium;

an image detection unit configured to detect the visible images formed on the surface of the endless traveling member; and a controller configured to control rotation of the plurality of image bearing members according to a velocity fluctuation pattern of each surface of the image bearing members, wherein the velocity fluctuation pattern is based on a detection time interval between forming predetermined visible detection images on the surface of the image bearing member and detecting, by the image detection unit, the predetermined visible detection images transferred from the surface of the image bearing member to the endless traveling member, wherein each of the plurality of driven gears comprises a gear portion and an engaging portion integrated therewith, the gear portion having a geared circumference and the engaging portion engaging the image bearing member, wherein the engaging portion of each of the driven gears includes a cylindrical concave portion which receives a coupling of each of the image bearing members, wherein an inner gear circumference is provided in the cylindrical concave portion and the coupling includes gears which mesh with the inner geared circumference of the engaging portion, wherein each of the plurality of driven gears further comprises a marking blade member provided on the gear portion which protrudes in a direction of rotation of the driven gear, the marking blade member rotates coaxially with the image bearing member, wherein the velocity fluctuation pattern is a velocity fluctuation pattern detected based on a rotation lap of the image bearing member, and wherein the controller determines a timing of starting forming the predetermined visible detection images on each surface of the image bearing members based on detection results from each of a plurality of rotation angle detection units, each rotation angle detection unit detects when rotation of the corresponding driven gear arrives at a predetermined angle when the marking blade member faces a position sensor and the marking blade member is detected by the position sensor.

2. The image forming apparatus according to claim 1, wherein the controller is configured to start forming the predetermined visible detection images when the rotation of the driven gear arrives at the predetermined angle.

3. The image forming apparatus according to claim 1, wherein the controller is configured to adjust a driving velocity of the drive source to a drive velocity pattern that cancels the fluctuation in the surface velocity of the image bearing member obtained from analysis of the timing of starting forming the predetermined visible detection images and the velocity fluctuation pattern of the surface of the image bearing member.

4. The image forming apparatus according to claim 3, wherein the controller is configured to drive the drive source at a constant velocity when the maximum fluctuation in the velocity fluctuation pattern corresponding to the drive source is at or below a threshold value.

5. The image forming apparatus according to claim 3, wherein the controller is configured to correct the drive velocity pattern according to a calculation result obtained by calculating a time taken for the rotation lap of the driven gear at a particular timing based on the detection results of each of the rotation angle detection units for each of the driven gears.

6. The image forming apparatus according to claim 1, wherein the gear portion and the engaging portion of each of the driven gears are seamlessly integrated with each other so as to form a single unit such that there is no relative motion therebetween.

7. The image forming apparatus according to claim 1, wherein each of the driven gears directly contacts each of the drive gears, and each of the driven gears includes a diameter that is larger than each of the image bearing members.

8. The image forming apparatus according to claim 7, wherein a speed reduction ratio between the drive gear and the driven gear is 1:20.

9. The image forming apparatus according to claim 1, wherein the controller is configured to control rotation of the plurality of image bearing members only when attachment or detachment of a process unit is detected.

10. An image forming apparatus, comprising:

means for bearing visible images thereon;

means for driving the means for bearing visible images;

means for forming visible images on the means for bearing visible images based on image information;

means for endlessly moving a surface to sequentially pass positions facing the means for bearing visible images;

means for transferring visible images formed on the means for bearing visible images to a recording medium held on the means for endlessly moving a surface, or to the means for endlessly moving a surface and to the recording medium;

means for detecting visible images formed on the means for endlessly moving a surface; and means for controlling rotation of the means for bearing visible images according to a velocity fluctuation pattern of the means for bearing visible images, wherein the velocity fluctuation pattern is based on a detection time interval between forming predetermined visible detection images on the means for bearing visible images and detecting, by the means for detecting visible images, the predetermined visible detection images transferred from the means for bearing visible images to the means for endlessly moving a surface, and wherein the means for controlling rotation of the means for bearing visible images determines a timing of starting forming the predetermined visible detection images on the means for bearing visible images based on detection results from means for detecting rotation angle of the means for driving the means for bearing visible images.

11. The image forming apparatus according to claim 10, wherein the means for controlling rotation of the means for bearing visible images adjusts a driving velocity of the means for driving the means for bearing visible images to a drive velocity pattern that cancels a fluctuation in surface velocity of the means for bearing visible images obtained from analysis of the timing of starting forming the predetermined visible detection images and the velocity fluctuation pattern of the means for bearing visible images.

* * * * *